US009278529B2

(12) United States Patent
Akahane

(10) Patent No.: US 9,278,529 B2
(45) Date of Patent: Mar. 8, 2016

(54) LIQUID EJECTING HEAD, LIQUID EJECTING HEAD UNIT, LIQUID EJECTING LINE HEAD AND LIQUID EJECTING APPARATUS

(71) Applicant: SEIKO EPSON CORPORATION, Tokyo (JP)

(72) Inventor: Fujio Akahane, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/596,070

(22) Filed: Jan. 13, 2015

(65) Prior Publication Data

US 2015/0197090 A1 Jul. 16, 2015

(30) Foreign Application Priority Data

Jan. 14, 2014 (JP) ..... 2014-004482

(51) Int. Cl.
*B41J 2/14* (2006.01)
*B41J 2/155* (2006.01)

(52) U.S. Cl.
CPC ..... *B41J 2/1433* (2013.01); *B41J 2/155* (2013.01); *B41J 2002/14459* (2013.01); *B41J 2202/11* (2013.01); *B41J 2202/20* (2013.01)

(58) Field of Classification Search
CPC ..... B41J 2/1631; B41J 2/1433; B41J 2/1623; B41J 2/162; B41J 2/1628
USPC ..... 347/47
See application file for complete search history.

(56) References Cited

U.S. PATENT DOCUMENTS

| | | | | |
|---|---|---|---|---|
| 6,328,418 | B1 | 12/2001 | Yamada et al. | |
| 8,672,433 | B2 | 3/2014 | Kusakari | |
| 2005/0001877 | A1* | 1/2005 | Chikanawa et al. | 347/42 |
| 2008/0151001 | A1* | 6/2008 | Sudo et al. | 347/43 |
| 2010/0149264 | A1* | 6/2010 | Takimoto et al. | 347/47 |

FOREIGN PATENT DOCUMENTS

| | | |
|---|---|---|
| JP | 2001-058422 | 3/2001 |
| JP | 2013-049244 | 3/2013 |

* cited by examiner

*Primary Examiner* — Mainsh S Shah
*Assistant Examiner* — Yaovi Ameh
(74) *Attorney, Agent, or Firm* — Workman Nydegger

(57) ABSTRACT

A liquid ejecting head including a head main unit having L (L is an integer of 2 or more) nozzle rows parallel to one another in a first direction in which, for each nozzle row, in a case in which one side in a second direction that intersects the first direction at a predetermined angle in a range of 0 degrees to 90 degrees is the first side, the nozzle row furthest to the first side among the L nozzle rows does not have a nozzle positioned at a distance M or more further to the first side in the second direction than the nozzle furthest to the first side of a nozzle row neighboring in the second direction.

22 Claims, 12 Drawing Sheets

LIQUID EJECTING HEAD, LIQUID EJECTING HEAD UNIT, LIQUID EJECTING LINE HEAD AND LIQUID EJECTING APPARATUS

CROSS REFERENCES TO RELATED APPLICATIONS

This application claims priority to Japanese Patent Application No. 2014-004482 filed on Jan. 14, 2014. The entire disclosure of Japanese Patent Application No. 2014-004482 is hereby incorporated herein by reference.

BACKGROUND

1. Technical Field

The present invention relates to a liquid ejecting head that ejects a liquid from nozzle openings, a liquid ejecting head unit, a liquid ejecting line head, and a liquid ejecting apparatus, and, in particular, relates to an ink jet recording head, an ink jet recording head unit, an ink jet line recording head and an ink jet recording apparatus equipped with an ink jet recording head that ejects ink as a liquid.

2. Related Art

An ink jet recording head that is an example of a liquid ejecting head in which a plurality of linear recording head modules having one nozzle row are obliquely lined up has been proposed (refer to JP-A-2001-58422). The technology realizes a long recording head for multi-color recording in which lateral spreading of the arrangement of the nozzle heights in the scanning direction is suppressed.

However, since a plurality of head modules having one nozzle row is arranged in the technology in JP-A-2001-58422, it is necessary that many head modules be aligned, and there is a problem of shifts of nozzle position easily arising between nozzle rows, along with the assembly steps being complicated.

Such a problem is similarly present not only in an ink jet recording head, but also in liquid ejecting head units that eject liquids other than ink.

SUMMARY

An advantage of some aspects of the invention is to provide a liquid ejecting head, a liquid ejecting head unit, a liquid ejecting line head, and a liquid ejecting apparatus which may regulate nozzle position between nozzle rows with high precision in a liquid ejecting head with nozzle rows obliquely arranged, and for which the assembly steps are simple.

Aspect 1

According to an aspect of the invention, there is provided a liquid ejecting head including a nozzle main body including nozzle rows in which nozzles are lined up with a predetermined nozzle pitch in a first direction and which are L (L is an integer of 2 or more) nozzle rows parallel to one another, in which the head main body includes a nozzle plate in which the nozzles are provided, and a driving element for ejecting a liquid from the nozzles, in which each nozzle row is provided such that the distance between nozzles in each nozzle row is M in a case in which a nozzle position of each nozzle row is projected in a third direction orthogonal to a second direction with respect to a virtual line in the second direction that intersects the first direction at a predetermined angle in a range of 0 to 90 degrees, and the nozzle positions overlap between the L nozzle rows, or the distance between the L nozzle rows is shifted by M×(1/L) each in the second direction in a case in which the nozzle position of L nozzle rows is projected in the third direction with respect to a virtual line in the second direction, and a nozzle row furthest to the first side among the L nozzle rows does not have a nozzle positioned M or more further to the first side in the second direction than a nozzle of the nozzle row neighboring in the second direction furthest to the first side in a case in which one side in the second direction is a first side.

In the aspect, in the liquid ejecting head in which the nozzle rows are obliquely arranged, since the plurality of nozzle rows is arranged in one head main body, it is possible for the nozzle position between nozzle rows to be highly precisely regulated, and the assembly steps also become simple. In a case in which one side in the second direction is the first side, since the nozzle row furthest to the first side does not have a nozzle positioned further to the first side at a distance M or more in the second direction than the nozzle furthest to the first side of the nozzle row neighboring in the second direction, in either aspect of (a) or (b), it is possible for unnecessary nozzles to be removed, and for the nozzles of the nozzle rows to be utilized at a high efficiency, where (a) is an aspect in which each nozzle row is provided such that the nozzle positions between L nozzle rows overlap, in a case in which the nozzle positions of L nozzle rows is projected in the third direction with respect to a virtual line in the second direction and (b) is an aspect in which each nozzle row is provided such that the distance between nozzles of L nozzle rows is shifted in second direction by M×(1/L) each, in a case in which the nozzle positions of L nozzle rows is projected in the third direction with respect to a virtual line in the second direction. With respect to the nozzle row furthest to the first side, the nozzle row neighboring the nozzle row in the second direction is provided on the side opposite the first side.

Aspect 2

In the Aspect 1, it is preferable that, in a case in which another side in the second direction is a second side, a nozzle row furthest to the second side among the L nozzle rows not have a nozzle positioned M or more further to the second side in the second direction than nozzles of a nozzle row neighboring in the second direction furthest to the second side. In this case, it is possible for unnecessary nozzles to be removed on the other side, and for the nozzles of the nozzle rows to be utilized at a higher efficiency.

Aspect 3

In Aspects 1 and 2, it is preferable that the nozzle row furthest to the first side include a nozzle furthest to the first side of the nozzle row neighboring in the second direction, and a nozzle furthest to the first side at the same position in the second direction. Accordingly, it is possible for liquid to be ejected to the same position in the second direction at by the nozzle row furthest to the first side and the nozzle row neighboring the nozzle row in the second direction.

Aspect 4

In Aspects 1 and 2, it is preferable that the nozzle row furthest to the first side include a nozzle furthest to the first side of the nozzle row neighboring in the second direction, and a nozzle furthest to the first side at a position on the first side of −M×(L−1)/L or more and M×(L−1)/L or less in the second direction. In this case, it is possible for a high resolution head to be realized, and for the nozzles of the nozzle row to be efficiently utilized.

Aspect 5

In Aspects 1 to 4, it is preferable that each nozzle row have the same number of nozzles. Thereby, it is possible for the number of overlaps between each nozzle row in the third direction to be the same, and efficient liquid ejection is possible.

Aspect 6

In Aspects 1 to 5, it is preferable that the head main body have one nozzle plate with respect to the L nozzle rows. Thereby, it is possible to realize the arrangement of each nozzle row with higher precision.

Aspect 7

In Aspect 6, it is preferable that nozzle plate have a parallelogram shape having sides along each of the first direction and the third direction. Thereby, it is possible for the size of the nozzle plate in which the collection of a plurality of nozzle rows is arranged in a parallelogram shape is arranged to be reduced, and increased integration is possible.

Aspect 8

In Aspects 1 to 7, it is preferable that the first direction and the third direction intersect at an angle greater than 0 degrees and less than 45 degrees. Thereby, it is possible to reduce the inter-nozzle distance in the second direction compared to a case of intersecting at an angle greater than 45 degrees and less than 90 degrees, and it is possible to realize a high resolution head.

Aspect 9

In Aspects 1 to 8, it is preferable that N and M have an integer ratio relation, when a distance in the third direction between neighboring nozzles of each nozzle row is N. Thereby, association of each nozzle and pixel becomes easy in a case of printing image data configured from pixels arranged in a matrix form in the second and third directions.

Aspect 10

In Aspects 1 to 9, it is preferable that the L nozzle rows be two nozzle rows. Thereby, it is possible to highly precisely regulate the nozzle position between nozzle rows, and the yield of each head main body is improved along with the result of the assembly steps becoming simple.

Aspect 11

In Aspects 1 to 10, it is preferable that the two nozzle rows be arranged between manifolds of each of the two nozzle rows in a direction orthogonal to the first direction. Thereby, it is possible for the area necessary for the nozzle plate to be reduced in a case of including one nozzle plate with respect to two nozzle rows.

Aspect 12

In Aspects 1 to 11, it is preferable that a dummy nozzle be included in each nozzle row. In each nozzle row, it is possible to make the influence exerted from the neighboring nozzles during liquid ejection even out between the nozzles of the end portion and the nozzles of the center.

Aspect 13

In Aspects 1 to 12, it is preferable that nozzles that eject a plurality of different liquids be included in at least one nozzle row of each nozzle row. Thereby, since it is possible to achieve space savings in a head that is able to eject a plurality of different liquids, and to eject each liquid using a plurality of nozzle rows, it is possible for the ejection amount of each liquid to be increased, and for the resolution of each liquid to be further improved.

Aspect 14

According to another aspect of the invention, there is provided a liquid ejecting head unit in which a plurality of head main bodies according to the above-described Aspects 1 to 13 are arranged fixed to a common fixing plate.

In this case, it is possible for the yield of each head main body to be improved, and it is possible to comparatively easily realize positioning of each head main body by fixing and arranging the plurality of head main bodies to a common fixing plate.

Aspect 15

In Aspect 14, it is preferable that the fixing plate have a parallelogram shape having sides along each of the first direction and the third direction. It is possible for the size of the fixing plate in the third direction to be reduced, and it is possible for the fixing plate to be lined up without gaps when arranging a plurality of fixing plates.

Aspect 16

In Aspects 14 and 15, it is preferable that a position of a portion of the nozzle rows of one head main body in the second direction and a position of a portion of the nozzle rows of a head main unit neighboring thereto in the second direction among the plurality of head main units overlap in the third direction. Thereby, it is possible for the image quality of joints between head main bodies to be improved.

Aspect 17

According to still another aspect of the invention, there is provided a liquid ejecting line head in which a plurality of liquid ejecting head units according to the above-described Aspects 14 to 16 is lined up in the second direction.

In this case, it is possible to configure the line head by lining up a plurality head units. Since it is possible to make the order of overlapping in the third direction between nozzle rows in the head unit and the order of overlapping in the third direction between nozzle rows between head units the same, it is possible to even out the overlapping order of colors.

Aspect 18

According to still another aspect of the invention, there is provided a liquid ejecting apparatus including the liquid ejecting head, the liquid ejecting head unit, or the liquid ejecting line head according to the above-described Aspects 1 to 13.

In this case, it is possible to highly precisely regulate the nozzle positions between nozzle rows, and it is possible to realize a liquid ejecting apparatus provided with a liquid ejecting head for which the assembly steps are simple.

BRIEF DESCRIPTION OF THE DRAWINGS

The invention will be described with reference to the accompanying drawings, wherein like numbers reference like elements.

DESCRIPTION OF EXEMPLARY EMBODIMENTS

Detailed description is provided below based in the embodiments.

Embodiment 1

Figure 1:
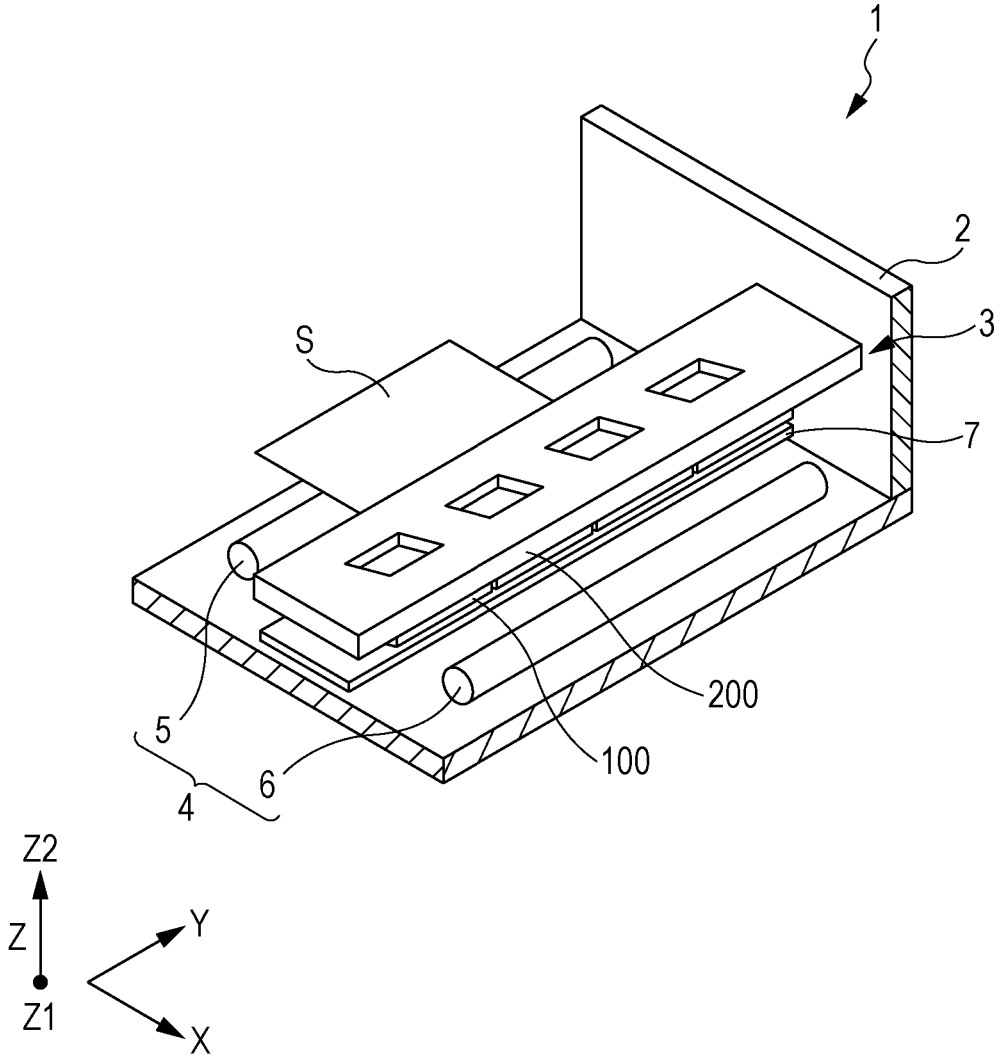
FIG. 1 is a schematic perspective view of a recording apparatus according Embodiment 1 of the invention.

FIG. 1 is a perspective view illustrating a schematic configuration of ink jet recording apparatus that is an example of a liquid ejecting apparatus according to Embodiment 1 of the invention.

The ink jet recording apparatus that is an example of the liquid ejecting apparatus of the embodiment, is a so-called line recording apparatus in which tan ink jet recording head unit that is an example of the liquid ejecting head unit is fixed, and performed printing by transporting a recording sheet S, such as a paper, that is an ejection target medium.

Specifically, as shown in FIG. 1, the ink jet recording apparatus 1 includes an apparatus main body 2, an ink jet recording head unit 3 (below, referred to simply as a head unit 3) in which a plurality of ink jet recording heads 100 are provided and which is fixed to the apparatus main body 2, a transport unit 4 that transports the recording sheet S, and a support member 7 that supports the recording sheet S facing the head unit 3. In the embodiment, the transport direction of the recording sheet S is referred to as the X direction (corresponds to the third direction of the invention). In the in-plane direction in which the nozzle openings of the head unit 3 are opened, the direction orthogonal to the X direction is referred to as the Y direction (corresponds to the second direction of the invention). The direction orthogonal to the X direction and the Y direction is referred to as the Z direction. In the plane including the Z direction, the liquid ejection direction side (recording sheet S side) is referred to as the Z1 side, and the opposite side as the Z2 side.

The head unit 3 includes a plurality of ink jet recording heads 100, and a head fixing substrate 200 that holds the plurality of ink jet recording heads 100.

The plurality of ink jet recording heads 100 is arranged in parallel in the Y direction that is the direction that intersects the X direction that is the transport direction, and is fixed to the head fixing substrate 200. In the embodiment, a plurality of ink jet recording heads 100 is arranged in parallel on a straight line in the Y direction. That is, the plurality of ink jet recording heads 100 is not arranged shifted in the X direction. In so doing, it is possible for the width of the head unit 3 in the X direction to be narrowed, and to achieve size reductions in the head unit 3.

The head fixing substrate 200 holds the plurality of ink jet recording heads 100 so that the nozzle openings 21 of the plurality of ink jet recording heads 100 face the recording sheet S side, and is fixed to the apparatus main body 2.

The transport unit 4 transports the recording sheet S in the X direction with respect to the head unit 3. The transport unit 4, for example, includes a first transport roller 5 and a second transport roller 6 provided on both sides in the X direction that is the transport direction of the recording sheet S with respect to the head unit 3.

The recording sheet S is transported by such a first transport roller 5 and second transport roller 6. The transport unit 4 that transports the recording sheet S is not limited to a transport roller, and may be a belt, drum, or the like.

The support member 7 supports the recording sheet S transported by the transport unit 4 at a position facing the head unit 3. The support member 7 is formed from a metal or resin in which the cross-section provided facing the head unit 3 has rectangular shape between the first transport roller 5 and the second transport roller 6.

An adsorption unit that adsorbs the transported recording sheet S on the support member 7 is preferably provided in the support member 7. Examples of the adsorption unit include units that suction-adsorb by suctioning the recording sheet S and units that electrostatically adsorb the recording sheet with an electrostatic force. In a case where the transport unit 4 is a belt or a drum, the support member 7 supports the recording sheet S on the belt or drum at a position facing the head unit 3.

Although not shown, a liquid storage unit, such as an ink tank or an ink cartridge, in which ink is stored is connected so as to be able to supply ink to each ink jet recording head 100 of the head unit 3. The liquid storage unit may be held the on the head unit 3, or may be held at position different to the head unit 3 in the apparatus main body 2. A flow channel or the like that supplies ink supplied from the liquid storage unit to the ink jet recording head 100 may be provided inside the head fixing substrate 200, or a flow channel member may be provided in the head fixing substrate 200 and ink from the liquid storage unit may be supplied to the ink jet recording head 100 via the flow channel member. Naturally, ink may be supplied directly to the ink jet recording head 100 from the liquid storage unit without passing through the head fixing substrate 200 or the flow channel member, or the like, fixed to the head fixing substrate 200.

In such an ink jet recording apparatus 1, the recording sheet S is transported by the first transport roller 5, and the recording sheet S supported on the support member 7 by the head unit 3 is subjected to printing. The printed recording sheet S is transported by the second transport roller 6.

Figure 2:
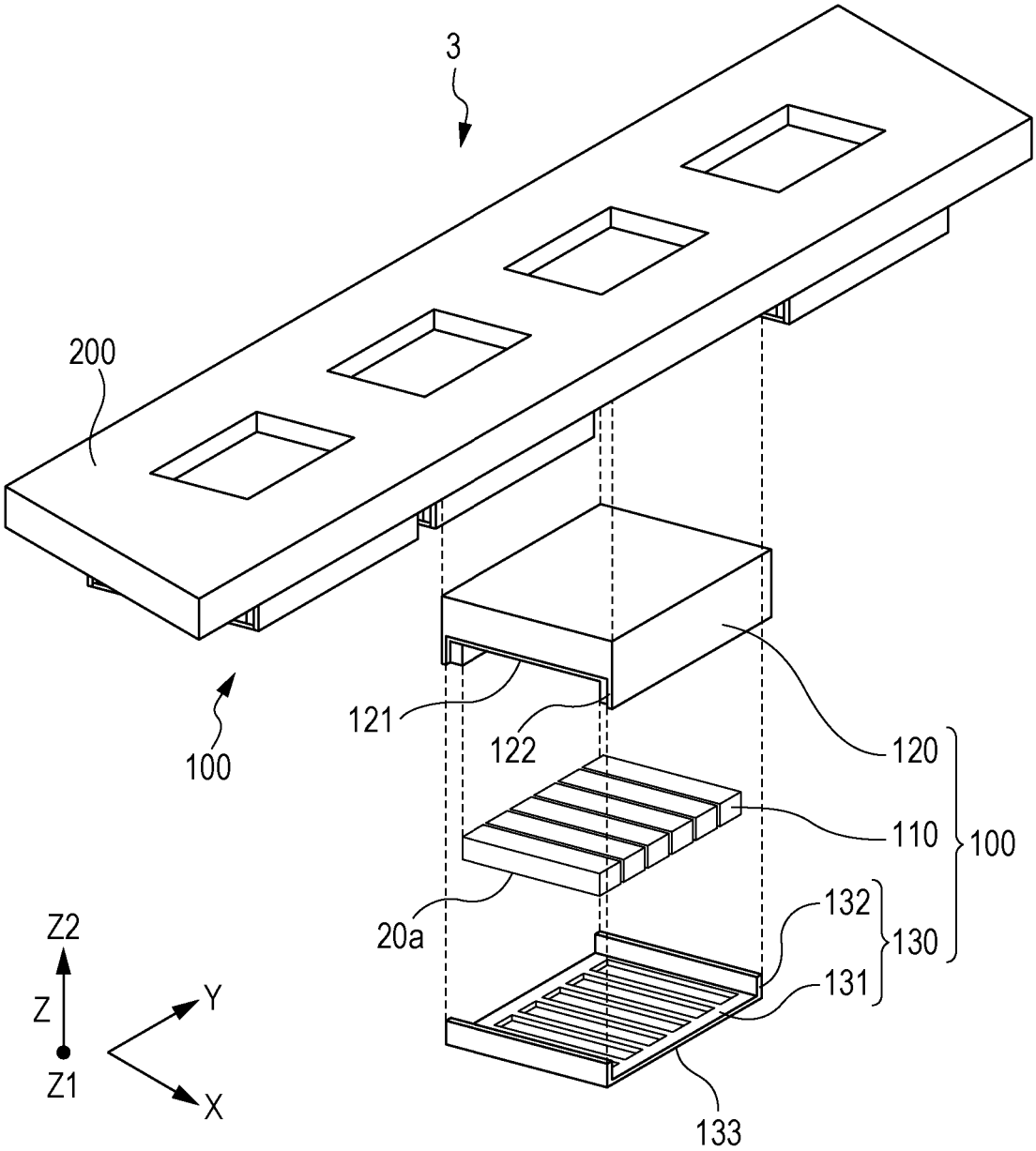
FIG. 2 is an exploded perspective view of a head unit according Embodiment 1 of the invention.
Figure 3:
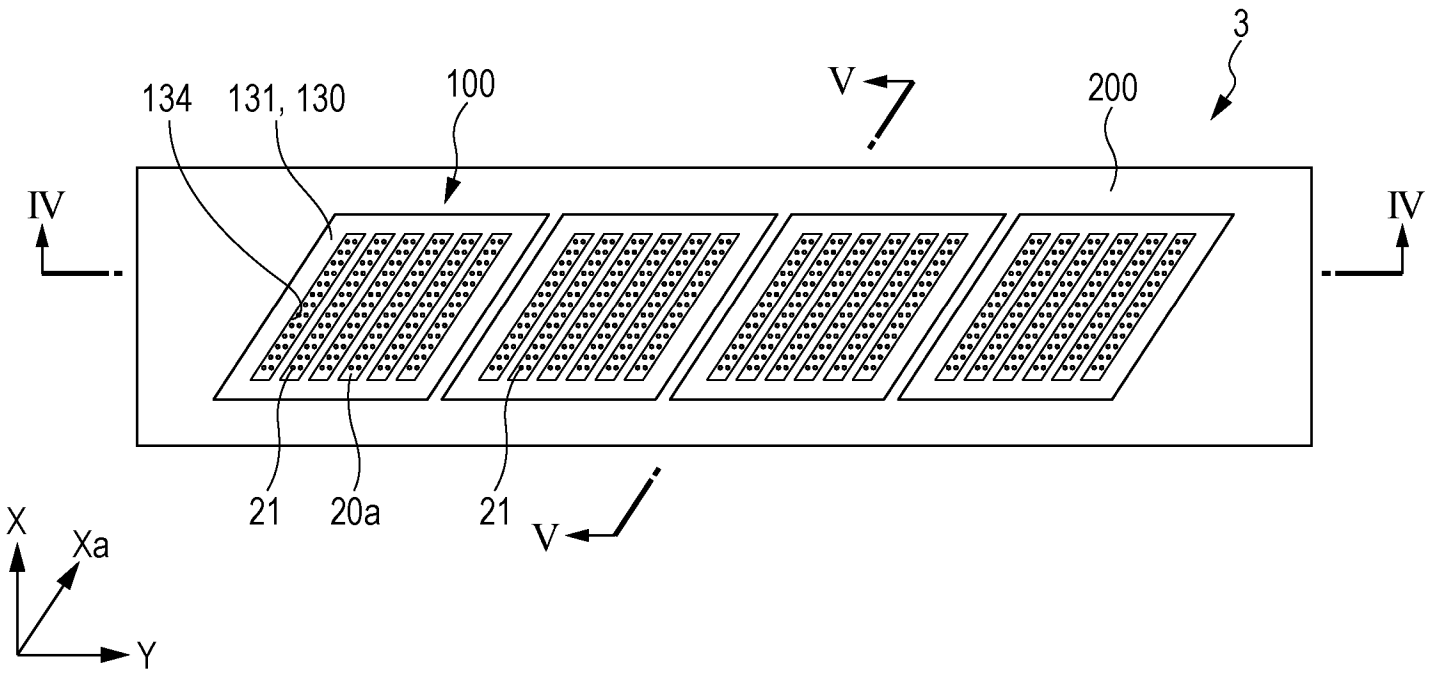
FIG. 3 is a plan view of a head unit according Embodiment 1 of the invention.
Figure 4A:
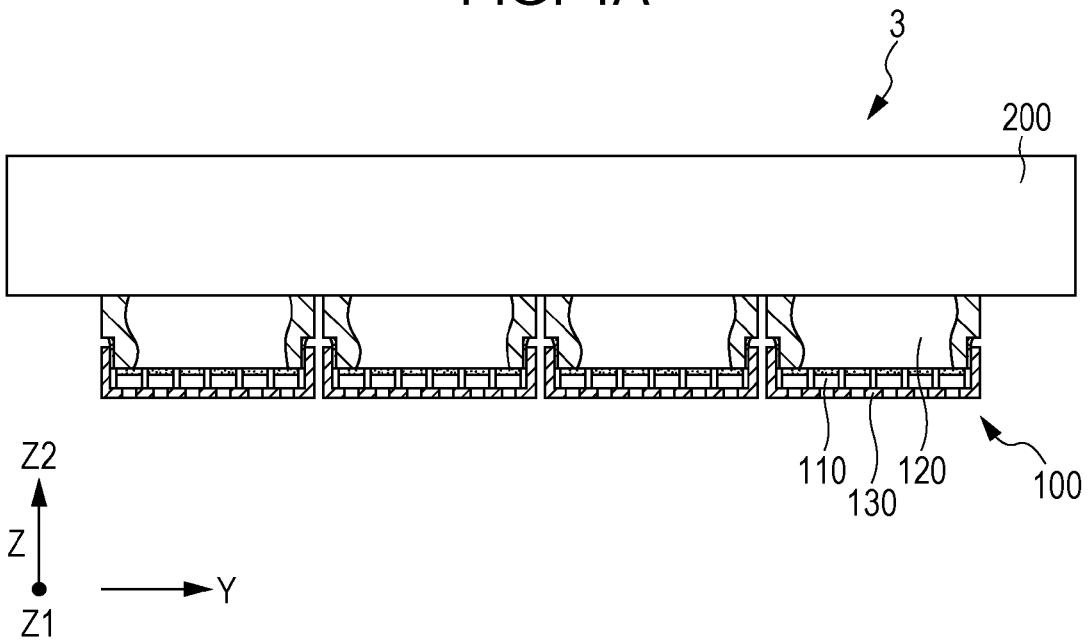
FIGS. 4A and 4B are a cross-sectional view and an enlarged view, respectively, of a head unit according Embodiment 1 of the invention.
Figure 4B:
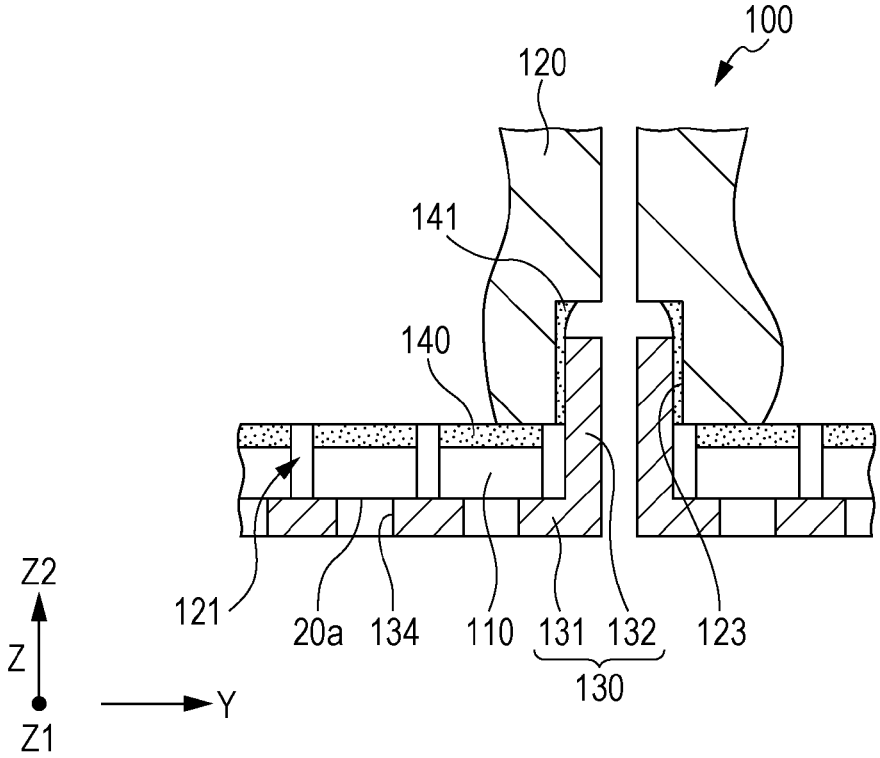
Figure 5:
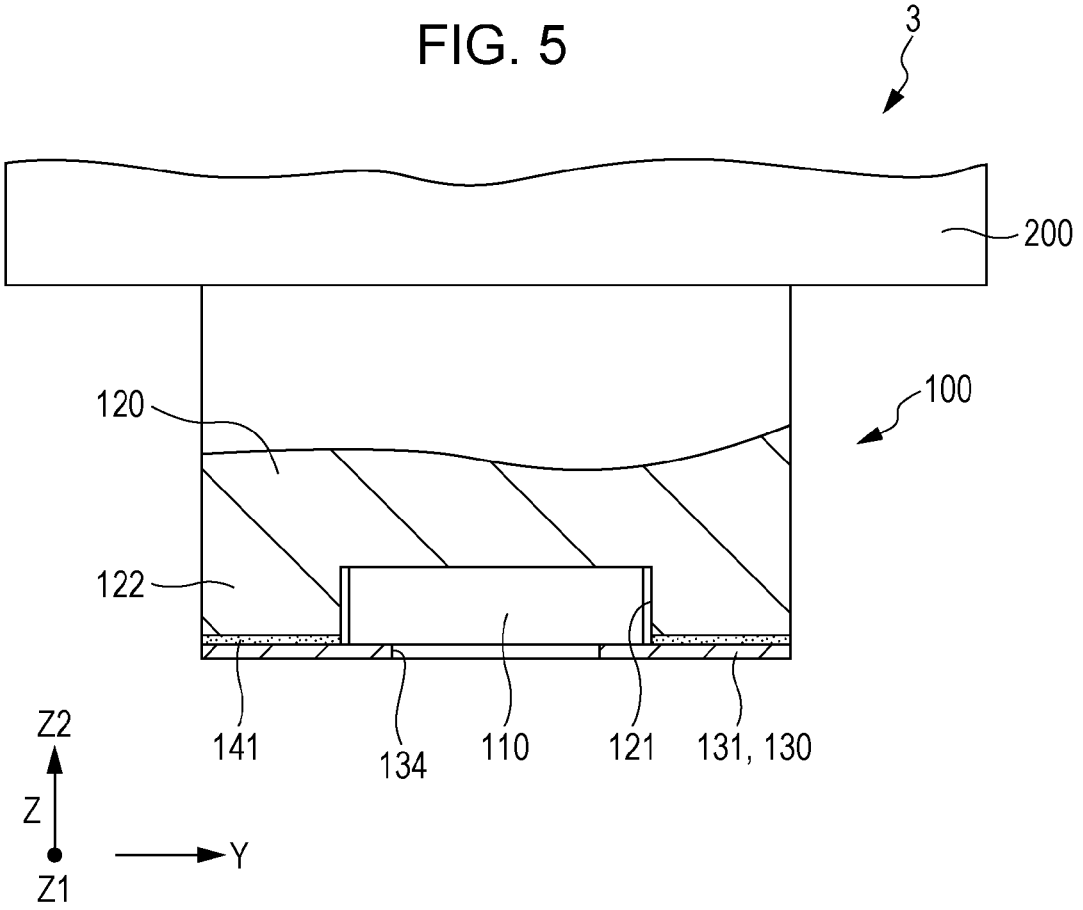
FIG. 5 is a cross-sectional view of a head unit according Embodiment 1 of the invention.

The head unit 3 mounted to such an ink jet recording apparatus 1 will be described in further detail with reference to FIGS. 2 to 5. FIG. 2 is an exploded perspective view illustrating an ink jet recording head unit that is an example of the liquid ejecting head unit according to Embodiment 1, FIG. 3 is a plan view of the liquid ejecting surface side of the ink jet recording head unit, FIGS. 4A and 4B are a cross-sectional view with essential parts removed and a view with the essential parts enlarged taken along line IVA-IVA and line IVB-IVB in FIG. 3, respectively, and FIG. 5 is a cross-sectional view with the essential parts removed taken along line V-V in FIG. 3.

As shown in the drawings, the head unit 3 of the embodiments includes a plurality of ink jet recording heads 100, and a head fixing substrate 200 that holds the plurality of ink jet recording heads 100.

The ink jet recording head 100 includes a liquid ejecting surface 20*a* in which nozzle openings 21 are provided on the Z1 side in the Z direction.

Such an ink jet recording head 100 is fixed to the surface side of the head fixing substrate 200 facing the recording sheet S, that is, the Z1 side that is the recording sheet S side in the Z direction.

As described above, the plurality of ink jet recording heads 100 is arranged in parallel on a straight line in the Y direction that is a direction orthogonal to the X direction that is the transport direction, and is fixed to the head fixing substrate 200. That is, the plurality of ink jet recording heads 100 is not arranged shifted in the X direction. In so doing, it is possible for the width of the head unit 3 in the X direction to be narrowed, and to achieve size reductions in the head unit 3. Naturally, although the ink jet recording heads 100 arranged in parallel in the Y direction may be arranged shifted in the X direction, when the ink jet recording heads 100 are shifted greatly in the X direction, the width of the head fixing substrate 200 or the like increases in the X direction. When the size of the head unit 3 increases in this way in the X direction, the distance in the X direction between the first transport roller 5 and the second transport roller 6 in the ink jet recording apparatus 1 becomes large, and fixing the posture of the recording sheet S becomes difficult. The head unit 3 and the ink jet recording apparatus 1 increase in size.

In the embodiment, although four ink jet recording heads 100 may be fixed to the head fixing substrate 200, if the number of ink jet recording heads 100 is two or more, there is no particular limitation thereto.

An example of the ink jet recording head mounted to such a head unit will be described in further detail.

As shown, the ink jet recording head 100 is provided with a plurality of head main bodies 110, a holder 120 that is a holding member of the embodiment and that holds the plurality of head main bodies 110, and a cover 130 that is a fixing plate provided on the liquid ejecting surface 20*a* side of the head main body 110.

The head main body 110 has a liquid ejecting surface 20*a* in which nozzle openings 21 are provided on the Z1 side in the Z direction. The Z2 side of the plurality of head main bodies 110 is adhered to the surface of the Z1 side of the holder 120.

The holder 120 has a holding portion 121 that forms a groove-shaped space on the Z1 side. By being continuously provided along the Y direction on the surface of the Z1 side of the holder 120, the holding portion 121 is provided and opened in both side surfaces in the Y direction. By providing the holding portion 121 in the approximately central portion in the X direction, the holder 120 has leg portions 122 formed on both sides of the holding portion 121 in the X direction. That is, the leg portions 122 are provided only on both end portions in the X direction on the surface of the Z1 side of the holder 120, and are not provided at both end portions in the Y direction.

In such a holding portion 121, the plurality of head main bodies 110 are adhered to one another by an adhesive 140. That is, the leg portions 122 are positioned on both sides in the X direction with respect to the head main body 110. The surfaces of the holder 120 and the head main body 110 facing one another in the Z direction are adhered by the adhesive 140. A flow channel or the like that supplies ink to the head main body 110 is provided inside, not shown, of the holder 120, and the flow channel of the holder 120 and the flow channel of the head main body 110 are communicated by being sealed by the adhesive 140. The holder 120 may be configured a plurality of members being stacked in the Z direction.

Although described in detail later, the head main body 110 is configured by a plurality of members being stacked. Variations in the height in the Z direction of the plurality of head main bodies 110 according to the dimensional tolerance of the plurality of members that configure each head main body 110, variations in the thickness of the adhesive or the like, that stacks the plurality of members, and the like arise. The plurality of head main bodies 110 in which high variations in the Z direction arise is held by the common holder 120, and in order for the liquid ejecting surface 20*a* of the plurality of head main bodies 110 to be even on the plane, that is, for the height in the Z direction of the liquid ejection surface 20*a* to be aligned, it is necessary that the height variations of the head main body 110 be absorbed by the adhesive 140 that adheres the holder 120 and the head main body 110. It is preferable that an adhesive with a comparatively high viscosity be used as the adhesive 140 that absorbs the height variations in the head main body 110. Even if the adhesive 140 is an adhesive with a comparatively high viscosity, a problem that the moisture included in the ink evaporates from the adhesive 140 that adheres the holder 120 and the head main body 110 may arise. Naturally, even if only one head main body 110 is provided, there is concern of the moisture included in the ink evaporating from the adhesive 140 that adheres the head main body 110 and the holder 120. That is, even in a case in which the height variations are not absorbed by the adhesive 140 that adheres the head main body 110 and the holder 120, there is concern of moisture evaporation from the adhesive 140 that adheres the head main body 110 and the holder 120 occurring.

Incidentally, even though the holder 120 and the head main body 110 are thought to be fixed by a screw or the like, the head main body 110 has a small form, and, in the embodiment, because it is necessary that a plurality be attached with respect to one holder 120, fixing with a screw or the like via a seal member formed from an elastic material is difficult. Accordingly, by adhering the head main body 110 and the holder 120 with the adhesive 140, it is possible to reduce the number of components, thereby reducing costs, and to seal the flow channel by which both are connected, without providing a seal member formed from an elastic material between both.

The plurality of head main bodies 110 is provided in parallel in the Y direction and adhered in the holding portion 121 of the holder 120. In the embodiment, six head main bodies 110 are adhered to one holder 120. Naturally, the number of head main bodies 110 fixed to the one holder 120 is not limited to the above, and one head main body 110 may be provided with respect to the one holder 120, or a plurality of two or more may be provided. Incidentally, by achieving multiple rows of nozzle rows by providing a plurality of head main bodies 110 with respect to one ink jet recording head 100, it is possible for the yield to be improved compared to a case of creating multiple rows by providing a plurality of nozzle rows in only one head main body 110 with respect to one ink jet recording head 100. That is, creating multiple nozzle rows in a single head main body 110 lowers the yield of the head main body 110 and increases the manufacturing costs. In contrast, by fixing a plurality of head main bodies 110 in one common holder 120, thereby creating multiple nozzle rows with a plurality of head main bodies 110, it is possible for the yield of the head main body 110 to be improved, and the manufacturing costs reduced.

The plurality of head main bodies 110 of the embodiment, in the in-plane direction of the liquid ejecting surface 20*a*, the nozzle rows are fixed so as to be inclined with respect to the X direction that is the transport direction of the recording sheet S. That is, the Xa direction (corresponds to the first direction of the invention) that is the parallel direction of the nozzle openings 21 that configure the nozzle row intersects the X direction at an angle greater than 0 degrees and less than 90 degrees, and becomes inclined. Here, the X direction and Xa direction preferably intersect at an angle greater than 0 degrees and less than 45 degrees. In so doing, when compared to a case of intersecting at an angle greater than 45 degrees and less than 90 degrees, even if the nozzle gap in the Xa direction is large, it is possible for the nozzle gap in the Y direction for the nozzle openings 21 thereof to be further reduced. Here, the X direction and the Xa direction intersecting at an angle greater than 0 degrees and less than 45 degrees refers to a state in which the nozzle rows are inclined further toward the X direction than a straight line that intersects the X direction at 45 degrees in the in-plane direction of the liquid ejecting surface 20*a*.

In the embodiment, the ink jet recording head 100 includes a plurality of head main bodies 110 arranged in parallel in the Y direction, and it is possible for at least portions of the nozzle openings 21 of the head main bodies 110 adjacent in the Y direction to overlap each other in the X direction, that is, to be arranged at positions that overlap. The plurality of ink jet recording heads 100 is provided in parallel in the Y direction, and it is possible for at least portions of the nozzle openings 21 of the ink jet recording heads 100 adjacent in the Y direction to overlap each other in the X direction, that is, to be arranged at positions that overlap. Thus, it is possible to form nozzle openings 21 arranged in parallel with a similar gap in the Y direction from the furthest head main body 110 on one side in the Y direction spanning the head main body 110 furthest to the other side, from among the head main bodies 110 with which the head unit 3 is equipped.

The cover 130 corresponds to the fixing plate of the embodiment and is formed from a plate-like member, such as a metal. The cover 130 is provided on the liquid ejecting surface 20*a* side of the ink jet recording head 100, that is, on the Z1 side of the ink jet recording head 100 in the Z direction.

The cover 130 is formed by bending a flat plate-shaped member, and is provided with a base portion 131 provided on the liquid ejecting surface 20*a* side, and a bent portion 132 provided by both ends of the base portion 131 in the Y direction being bent to the Z2 side in the Z direction. In the embodiment, since the bent portion is not provided on the side parts of both ends in the X direction, it is possible for the entire side part of both ends in the Y direction of the base portion 131 to be the bent portion 132, and an edge portion is not present. Meanwhile, the entirety of the side portion of both ends in the X direction becomes the edge portion 133.

The base portion 131, as shown in FIG. 5, is bonded to the surface of the holder 120 on the Z1 side in the Z direction, that is, to the end surface of the leg portion 122 on the Z1 side, via the adhesive 141.

Exposure opening portions 134 that are openings for exposing the nozzle openings 21 of each head main body 110 are provided in the base portion 131, as shown in FIGS. 4A and 4B. In the embodiment, the exposure opening portions 134 are provided so as to be independently opened for each head main body 110. That is, because the ink jet recording head 100 of the embodiment includes six head main bodies 110, six independent exposure openings 134 are provided in the base portion 131. Naturally, one common exposure opening portion 134 may be provided with respect to the head main body group configured by a plurality of head main bodies 110, according to the configuration or the like of the head main body 110.

In the embodiment, because the leg portions 122 are not provided in the Y direction of the holding portion 121, the exposure opening portions 134 are provided up to the vicinity of the bent portion 132 in the Y direction. That is, the gap from the entire periphery of the base portion 131 to the exposure opening portions 134 is smaller in the Y direction than in the X direction.

The Z1 side of the holding portion 121 of the holder 120 is covered by such a base portion 131.

Bent portions 132 are provided on both end portions of the base portion 131 in the Y direction, and are formed with a size that covers the opening area opened in the side surface of the holding portion 121 in the Y direction. That is, the bent portion 132 is a region from the end portion of the base portion 131 in the Y direction to the edge portion of the cover 130. Such a bent portion 132 is bonded to the side surface of the holder 120 in the Y direction via the adhesive 141. In so doing, the opening to the side surface of the holding portion 121 in the Y direction is covered and sealed by the bent portion 132.

That is, for the holder 120 and the cover 130, by both ends of the leg portions 122 in the Z direction and the base portion 131 being adhered by the adhesive 141 at both sides in the X direction, and the side surfaces in which the holding portions 121 are opened and the bent portion 132 being adhered by the adhesive 141 at both sides in the Y direction, the head main body 110 is arranged in the holding portion 121 that is a space between the holder 120 and the cover 130. That is, the adhesive 140 that adheres the head main body 110 and the holder 120 is encapsulated inside the holding portion 121 that is a space formed by adhering the holder 120 and the cover 130 with the adhesive 141. Accordingly, even if the adhesive 140 which moisture included in the ink easily passes through is used as the adhesive 140 that adheres the holder 120 and the head main body 110, because the inside of the holding portion 121 is sealed by the adhesive 141 that adheres the holder 120 and the cover 130, it is possible to suppress evaporation of the moisture included in the ink. In order to seal the holding portion 121, it is preferable that the base portion 131 of the cover 130 and the liquid ejecting surface 20*a* side of the head main body 110 be adhered. That is, it is favorable that the periphery of the exposure opening portion 134 be adhered to the head main body 110 so that the moisture does not evaporate to the outside via the exposure opening portion 134. It is favorable that the adhesive 141 that adheres the holder 120 and the cover 130 adhere the holder 120 and the head main body 110, and less easily allow moisture to pass through than the adhesive 140 that absorbs the variations in the height of the head main body 110.

In this way, in the embodiment, because the cover 130 and the holder 120 are adhered at both sides of the holder 120 in the Y direction by providing the bent portion 132 on the cover 130, it is not necessary to provide the leg portions for adhering the cover 130 and the base portion 131 on both sides of the holder 120 in the Y direction. Therefore, when the ink jet recording heads 100 are arranged in parallel in the Y direction, since the leg portions are not present on the sides between the ink jet recording heads 100 adjacent to one another, it is possible for the gap between ink jet recording heads 100 adjacent in the Y direction to be narrowed. In so doing, it is possible to provide head main bodies 110 of ink jet recording heads 100 adjacent in the Y direction in close contact with each other, and to provide nozzle openings 21 provided in each head main body 110 of adjacent ink jet recording heads in close contact in the Y direction.

Incidentally, in order to suppress the evaporation of the moisture included in the ink without providing the bent portion 132 adhered to the holder 120 on both sides of the cover 130 in the Y direction, it is necessary to provide the leg portions on both sides of the holder 120 in the Y direction and to adhere end surface of the Z1 side of the leg portion to the base portion 131. In other words, it is necessary to provide the holding portion 121 so as to be opened on only the Z1 side in the Z direction. When the leg portions are provided on both sides in the Y direction, the gap between the holding portions 121 of the adjacent ink jet recording heads 100 widens, thereby becoming difficult to provide the head main bodies 110 of the adjacent ink jet recording heads 100, and the nozzle openings 21 are arranged separated in the Y direction. That is, because the ink jet recording heads 100 adjacent to one another are provided in close contact, and the head main bodies 110 of each ink jet recording head 100 are provided in close contact with one another, it is preferable that the leg portions 122 not be provided on both sides in the Y direction that is the parallel direction of the ink jet recording heads 100. Openings that communicate with the space in which the head main bodies 110 are arranged are provided on both side surfaces of holding portion 121 in the Y direction. In such a configuration, when the cover 130 is adhered to only the end surface of the Z1 side of the leg portion 122 of the holder 120, the inside of the holding portion 121 is opened to the outside on both side surfaces in the Y direction, and moisture that passes through the adhesive 140 that adheres the holder 120 and the head main body 110 evaporates to the outside.

In the embodiment, by sealing the holding portion 121 opened in both side surfaces in the Y direction with the bent portion 132 of the cover 130 in order to provide the head main bodies 110 in close proximity, it is possible for the gap between ink jet recording heads 100 adjacent to one another in the Y direction to be narrowed without providing the leg portions on both sides in the Y direction, and it is possible to suppress evaporation of moisture passing through the adhesive 140 that adheres the head main body 110 and the holder 120, and possible to provide the nozzle openings 21 of the adjacent ink jet recording heads 100 in close contact.

In the embodiment, a concavity 123 is provided on the side surface of the holder 120 in the Y direction, and the bent portion 132 is adhered to the inside of the concavity 123. The concavity 123 is provided and opened in the surface of the Z1 side in the Z direction, and provided and opened in both side surfaces in the Y direction. By providing the concavity 123 in the holder 120 in this way, because the bent portion 132 is inserted and adhered in the concavity 123, it is possible for the holder 120 and the bent portion 132 of the cover 130 to be easily adhered. That is, by providing the concavity 123 in the holder 120, because between the holder 120 and the bent portion 132 of the cover 130 is filled with the adhesive 141 by capillary action simply by coating between the end portion of the bent portion 132 of the cover 130 inserted in the concavity 123 and the concavity 123 with the adhesive 141, a step for coating the adhesive 141 along the end portion of the bent portion 132 from a direction with a different inclination with respect to the gap between the holder 120 without a concavity 123 and the bent portion 132 becomes unnecessary, and it is possible to simplify the adhesion step. In the embodiment, by providing the concavity 123 in the holder 120, the amount of protrusion in the Y direction of the bent portion 132 of the cover 130 is reduced, it is possible for the gap between the ink jet recording heads 100 adjacent to one another in the Y direction to be further narrowed, and it is possible for the gap between nozzle openings 21 of the adjacent ink jet recording heads 100 to be further reduced. By providing the concavity 123 in the holder 120, and inserting the bent portion 132 in the concavity 123, even if variations in the degree of bending of the bent portion 132 arise, because it is possible for the amount of protrusion in the Y direction of the bent portion 132 to be reduced, it is possible to suppress the bent portion 132 from interfering with the adjacent ink jet recording heads 100. Even doing so, it is possible for the gap between ink jet recording heads 100 adjacent to each other to be narrowed.

In the head unit 3 of the embodiment, when a plurality of ink jet recording heads 100 in which evaporation of moisture in the ink is suppressed is arranged in parallel in the Y direction in the head fixing substrate 200, because it is possible for the gap between ink jet recording heads 100 adjacent to one another in the Y direction to be narrowed, it is possible for the gap between nozzle openings 21 of the adjacent ink jet recording heads 100 to be narrowed. Because it is possible for the gap between nozzle openings 21 of adjacent ink jet recording heads 100 to be narrowed, it is possible for a plurality of ink jet recording heads 100 to be arranged in parallel on a straight line extending in the Y direction, and for the width in the X direction of the head unit 3 to be reduced.

In the embodiment, because it is possible for the width in the X direction of the head unit 3 to be reduced, it is possible for the distance in the X direction between the first transport roller 5 and the second transport roller 6 to be shortened, and for fixing the posture of the recording sheet S to be simple, thereby improving printing quality. It is possible for the head unit 3 and the ink jet recording apparatus 1 to be reduced in size.

Such an ink jet recording head 100 of the embodiment has a shape that is an approximate parallelogram, when viewed in plan view from the liquid ejecting surface 20*a* side, as shown in FIG. 3. As described above, the Xa direction that is the parallel direction of the nozzle openings 21 that form the nozzle rows of each head main body 110 is provided inclined with respect to the X direction that is the transport direction of the recording sheet S because the outline of the ink jet recording head 100, that is, the approximate parallelogram shape of the cover 130 that is the fixing plate is formed so as to be the same as the Xa direction that is the direction in which the nozzle rows incline. Naturally, the shape when viewed in plan view from the liquid ejecting surface 20*a* side of the ink jet recording head 100 is not limited to the approximately parallelogram shape, and may be a trapezoidal rectangle or polygon.

By arranging a plurality of ink jet recording heads 100, thereby forming the ink jet recording head unit 3, the effects of improving the yield in manufacturing, simplicity of work, and simplification of the flattening of the plane of the cover 130 that is the fixing plate are exhibited.

In the embodiment, although the leg portions 122 are provided on both sides in the Y direction of the holder 120, the leg portions 122 may be not provided. That is, the head main body 110 may be adhered to the Z1 side of the holder 120, and the bent portion 132 may be provided on both sides in the X direction and the Y direction of the cover 130. That is, the bent portion 132 is provided on the cover 130 along the entire periphery in the in-plane direction of the liquid ejecting surface 20*a*, and the cover 130 may be adhered to along the entire periphery of the side surface of the holder 120. In so doing, it is possible for the width of the head unit 3 in the X direction to be further reduced. By reducing the width of the head unit 3 in the X direction, it is possible to provide a plurality of head units 3 in close contact in the X direction. However, even though it is necessary to form the cover 130 having a bent portion 132 along the entire periphery of such a base portion 131 by a drawing method or the like, there are cases where the length of the bent portion 132 is not sufficiently ensured in the drawing work, and manufacturing is difficult. By adhering the end surface on the Z1 side of the leg portion 122 as in the embodiment to the base portion 131 of the cover 130, it is possible for the strength of the ink jet recording head 100 in the Z direction to be improved. By adhering the end surface on the Z1 side of the leg portion 122 as in the embodiment to the base portion 131 of the cover 130, it is possible to support the pressure during adhering of the cover 130 and the holder 120 by the leg portion 122, and to suppress breakdowns of the head main bodies 110 by suppressing the application of direct pressure to the head main body 110.

In the embodiment, although the leg portion 122 is not provided on both sides of the holder 120 in the Y direction, by providing the leg portion 122 on both sides in the Y direction, it is possible for the strength of the ink jet recording head 100 in the Z direction to be improved. In this case, by making the length of the end surfaces of the Z1 side of the leg portion 122 provided on both sides in the Y direction smaller than the length in the X direction of the end surface of the Z1 side of the leg portion 122 provided on both sides in the X direction, it is possible to narrow the gap between ink jet recording heads 100 adjacent to one another in the Y direction. In this case, by adhering the bent portion 132 and the side surface of the holder 120 with the adhesive 141, it is possible to ensure a region necessary of adhering the cover 130 on the side surface of the holder 120, and to effectively suppress the evaporation of moisture.

In the embodiment, leg portion 122 is adhered to the base portion 131 on the liquid ejecting surface 20*a* side, without both end surface of the base portion 131 in the X direction being bent toward the Z2 side. Naturally, there is no limitation thereto, and for example, four corners that are both end portions in the X direction and both end portions in the Y direction of the base portion 131 may remain as an edge portion, and the bent portion may be formed in the X direction and the Y direction.

In so doing, it is possible to cover the corner portion in the X direction on the liquid ejecting surface 20*a* side of the ink jet recording head 100 with the cover 130, and to suppress defects, such as peeling of the cover 130 due to abutting of the recording sheet S.

Figure 6:
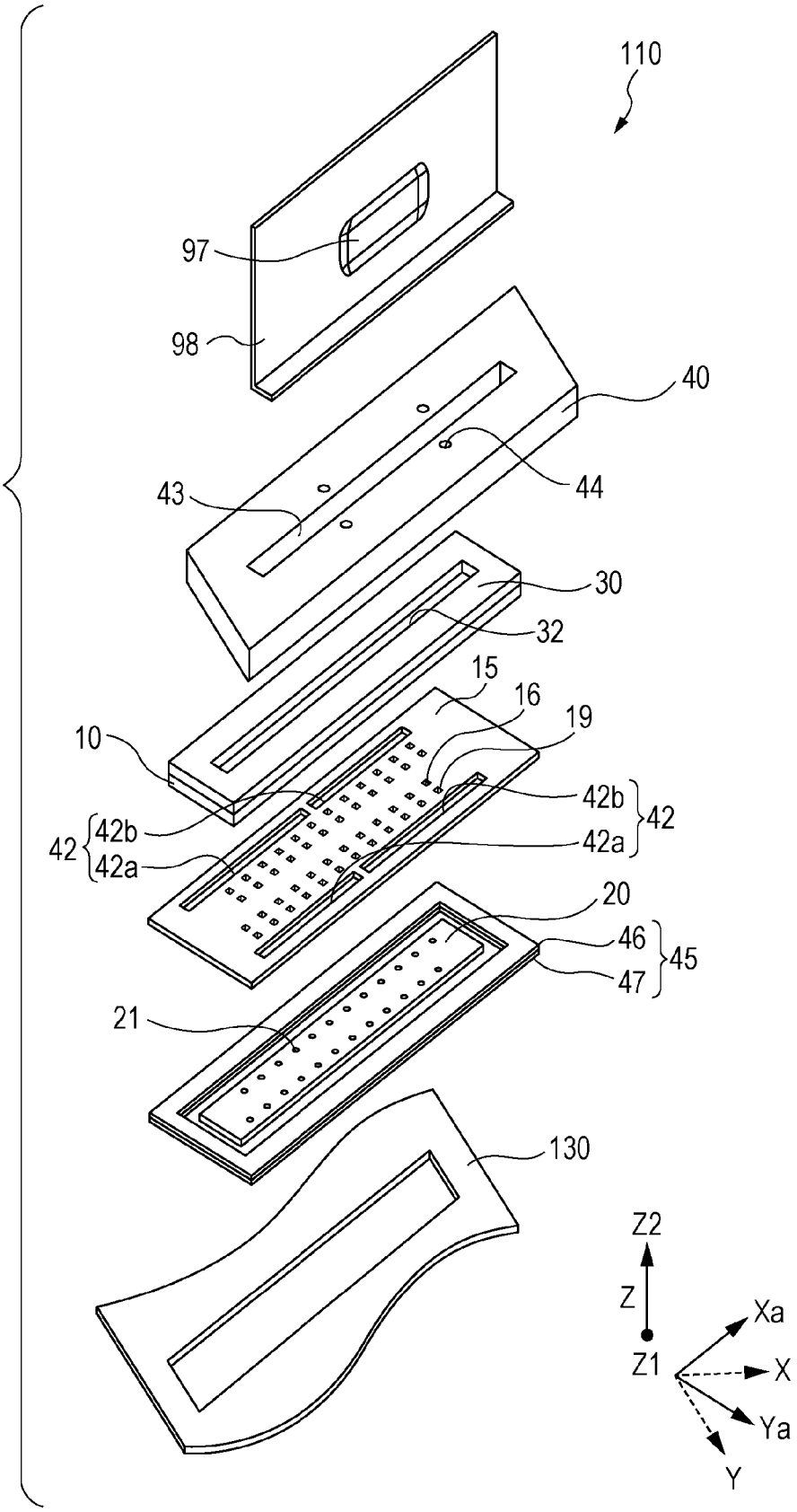
FIG. 6 is an exploded perspective view of a head main body according Embodiment 1 of the invention.
Figure 7:
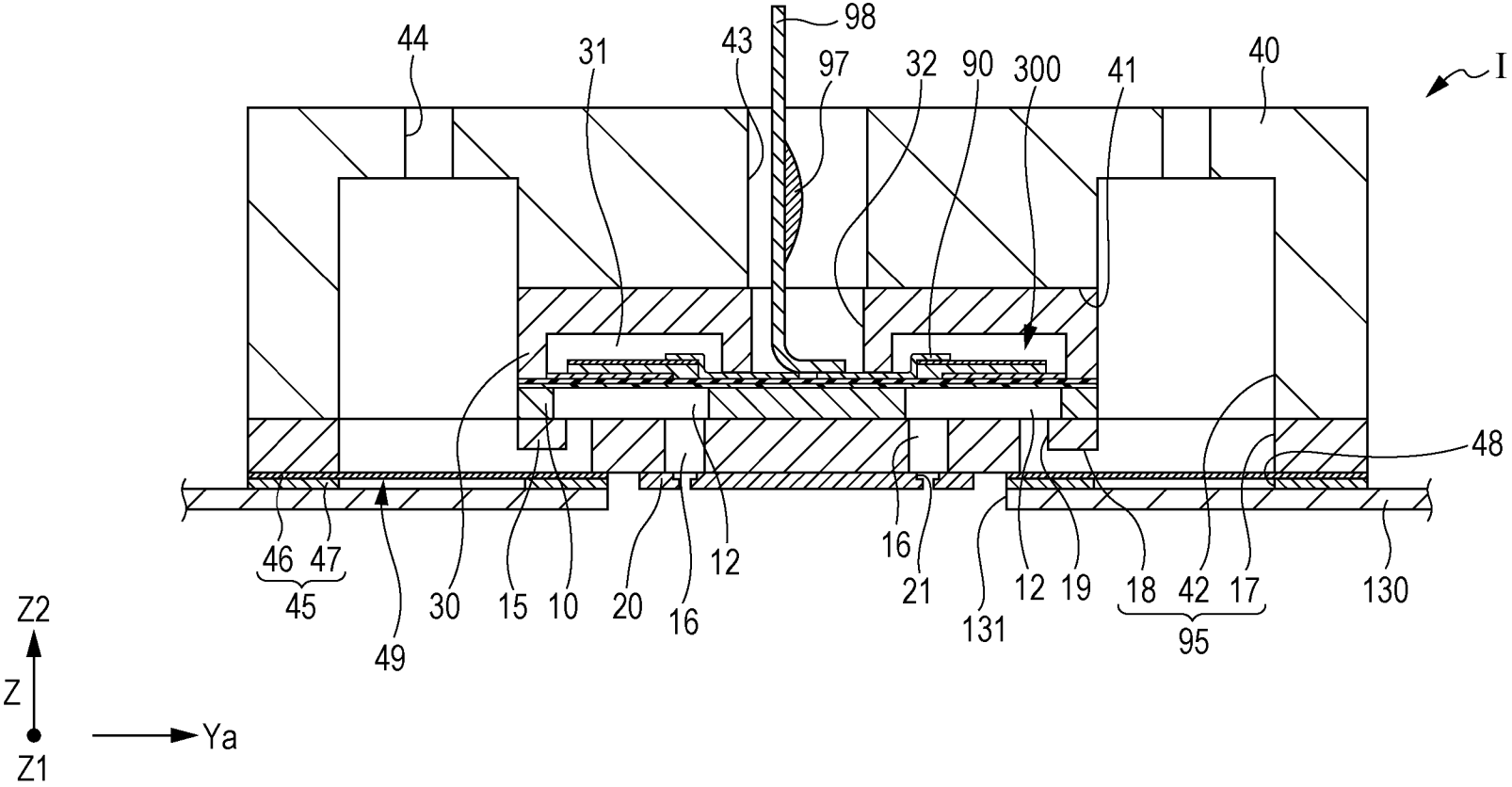
FIG. 7 is a cross-sectional view of a head main body according to Embodiment 1 of the invention.

Although an example of the head main body 110 of the ink jet recording head 100 of the above-described liquid ejecting apparatus is described below in detail, naturally, the structure of the head main body 110 is not limited to the structure below. FIG. 6 is a perspective view of the head main body according Embodiment 1 of the invention, and FIG. 7 is a cross-sectional view of the head main body in the Y direction.

As shown in the drawings, the head main body 110 of the embodiment includes a plurality of members, such as a flow channel-forming substrate 10, a communication plate 15, a nozzle plate 20, a protective substrate 30, a compliance substrate 45, and a case 40, and the plurality of members is bonded by an adhesive or the like.

As shown in the drawings, by subjecting the flow channel-forming substrate 10 that configures the head main body 110 to anisotropic etching from one surface side, the pressure generating chambers 12 partitioned by a plurality of partition walls is provided in parallel along the direction in which the plurality of nozzle openings 21 are provided in parallel. In the embodiment, the direction in which the pressure generating chambers 12 are arranged in parallel matches the Xa direction. In the flow channel-forming substrate 10, two rows are provided as the plurality of rows in which the pressure generating chambers 12 are arranged in parallel in the Xa direction in the embodiment. The row direction in which the rows of pressure generating chambers 12 in which the plurality of the pressure generating chambers 12 are formed along the Xa direction are arranged in rows is referred to below as the Ya direction. In the embodiment, the direction orthogonal to the Xa direction and the Ya direction matches the Z direction. The head main body 110 of the embodiment is mounted to the head unit 3 such that the Xa direction that is the parallel direction of the nozzle openings 21 is a direction inclined with respect to the X direction that is the transport direction of the recording sheet S.

In the flow channel-forming substrate 10, the opening area is narrower than the pressure generating chamber 12 in one end portion side of the pressure generating chamber 12 in the Ya direction, and supply path or the like that contributes flow path resistance of the ink flowing into the pressure generating chamber 12 may be provided.

As shown in FIG. 7, the communication plate 15 is bonded to one surface side of the flow channel-forming substrate 10. A nozzle plate 20 in which a plurality of nozzle openings 21 is provided that communicate with each pressure generating chamber 12 is bonded to the communication plate 15. In the embodiment, the Z1 side in the Z direction in which the nozzle openings 21 of the nozzle plate 20 are opened is the liquid ejecting surface 20*a*.

A nozzle communication path 16 that communicates the pressure generating chamber 12 and the nozzle openings 21 is provided in the communication plate 15. The communication plate 15 has a larger area than the flow channel-forming substrate 10, and the nozzle plate 20 has an area smaller than the flow channel-forming substrate 10. It is possible to achieve cost reductions by making the area of such a nozzle plate 20 comparatively small.

A first manifold 17 and a second manifold 18 that configure a portion of the manifold 95 are provided in the communication plate 15.

The first manifold 17 is provided penetrating the communication plate 15 in the Z direction.

The second manifold 18 is provided partway along in the Z direction opened to the nozzle plate 20 side of the communication plate 15 without penetrating the communication plate 15 in the Z direction.

A supply communication path 19 that communicates with one end portion of the pressure generating chamber 12 in the Y direction is independently provided for each pressure generating chamber 12 in the communication plate 15. The supply communication path 19 communicates the second manifold 18 and the pressure generating chamber 12.

Nozzle openings 21 that communicate with each pressure generating chamber 12 via the nozzle communication path 16 are formed in the nozzle plate 20. That is, the nozzle openings 21 that eject the same type of ink that is a liquid are provided in parallel in the Xa direction, and rows of nozzle openings 21 arranged in the Xa direction form two rows in the Ya direction. In the embodiment, as described in detail below, two types of liquid are able to be ejected by one nozzle row separated into two rows.

Meanwhile, a vibration plate is formed on the opposite surface side to the communication plate 15 of the flow channel-forming substrate 10. By sequentially layering the first electrode, the piezoelectric layer, and the second electrode layer on the vibration plate, a piezoelectric actuator 300 that is the piezoelectric unit of the embodiment is configured. Generally, any one of the electrodes in the piezoelectric actuator 300 forms a common electrode, and the other electrode and the piezoelectric layer are configured by being patterned for each of the pressure generating chambers 12.

A protective substrate 30 having approximately the same size as the flow channel-forming substrate 10 is bonded to the surface of the piezoelectric actuator 300 side of the flow channel-forming substrate 10. The protective substrate 30 includes a holding portion 31 that is a space for protecting the piezoelectric actuator 300. A through hole 32 that penetrates in the Z direction is provided in the protective substrate 30. The end portion of a lead electrode 90 drawn from the electrode of the piezoelectric actuator 300 is arranged so as to be exposed in the through hole 32, and the wiring substrate 98 to which the lead electrode and a driving circuit 97, such as a driving IC, are mounted are electrically connected in the through hole 32.

A case 40 that defines the manifold 95 that communicates with the plurality of pressure generating chamber 12 is fixed to the protective substrate 30 and the communication plate 15. The case 40 has substantially the same shape as the above-described communication plate 15 seen in plan view, and is bonded to the above-described communication plate 15 along with being bonded to the protective substrate 30. Specifically, the case 40 has a concavity 41 with a depth in which the flow channel-forming substrate 10 and the protective substrate 30 are accommodated in the protective substrate 30 side. The concavity 41 has a wider opening area than the surface bonded to the flow channel-forming substrate 10 of the protective substrate 30. The opening surface on the nozzle plate 20 side of the concavity 41 is sealed by the communication plate 15 in a state in which the flow channel-forming substrate 10 and the like is accommodated in the concavity 41. In so doing, a third manifold 42 is defined by the case 40, flow channel-forming substrate 10, and protective substrate 30 on the outer peripheral portion of the flow channel-forming substrate 10. The manifold 95 of the embodiment is configured by the third manifold 42 and the first and second manifolds 17 and 18 provided in the communication plate 15. Since it is possible to eject two types of ink with one nozzle row as described above, the first manifold 17, second manifold 18 and third manifold 42 that configure the manifold 95 are each divided in two in the nozzle row direction, that is, in the Xa direction. For example, the third manifold 42 is formed from a third manifold 42*a* and the third manifold 42*b*, as shown in FIG. 6. Other depictions are not provided.

In the embodiment, the first manifold 17, second manifold 18, and third manifold 42 that configure the manifold 95 are each symmetrically arranged with respect to the position of the nozzle row. Thereby, it is possible to eject different liquids for each nozzle row.

Naturally, the arrangement of the manifold is not limited thereto.

In the embodiment, although the manifold corresponding to each nozzle row is divided in two in the Xa direction making a total of four manifolds so as to be able to eject four types of liquid as described below, a manifold may be formed for each row, or one manifold may be formed for two rows.

A compliance substrate 45 is provided on the surface in which the first manifold 17 and the second manifold 18 of the communication plate 15 are opened. The compliance substrate 45 seals the opening of the first manifold 17 and the second manifold 18.

In the embodiment, such a compliance substrate 45 is provided with a sealing film 46 and a fixing substrate 47. The sealing film 46 is formed from a thin film having flexibility (for example, polyphenylene sulfide (PPS), stainless steel (SUS) or the like). The fixing substrate 47 is formed from a hard material, such as a metal such as stainless steel (SUS). Because the region facing the manifold 95 of the fixing substrate 47 forms an opening portion 48 that is completely removed in the thickness direction, one surface of the manifold 95 is a compliance portion 49 that is a flexible portion sealed only by the sealing film 46 having flexibility.

In the embodiment, the cover 130 that is the fixing plate is adhered opposite surface side to the communication plate 15 of the compliance substrate 45. That is, the exposure opening portion 134 provided in the base portion 131 of the cover 130 has a wider opening area than the area of the nozzle plate 20, and the liquid ejecting surface 20*a* of the nozzle plate 20 is exposed in the exposure opening portion 134. Naturally, the cover 130 is not limited thereto, and, for example, the exposure opening portion 134 of the cover 130 may be given an opening area smaller than the outline of the nozzle plate 20, and the cover 130 may abut on or be adhered to the liquid ejecting surface 20*a* of the nozzle plate 20. Naturally, in a case in which the exposure opening portion 134 of the cover 130 has a smaller opening area than the outline of the nozzle plate 20, the cover 130 and the liquid ejecting surface 20*a* may be provided so as to not be in contact. That is, the cover 130 being provided on the liquid ejecting surface 20*a* side includes not contacting the liquid ejecting surface 20*a* or contacting the liquid ejecting surface 20*a*.

In the embodiment, the cover 130 is adhered to the fixing substrate 47 of the compliance substrate 45. In so doing, it is possible to seal the holding portion 121 between the above-described cover 130 and the holder 120, and to suppress evaporation of the moisture in the ink.

An introduction path 44 for supplying ink to each manifold 95 by communicating with the manifold 95 is provided in the case 40. A connection port 43 in which the wiring substrate 98 is inserted by communicating with the through hole 32 of the protective substrate 30 is provided in the case 40.

In the head main body 110 of such a configuration, when ink is ejected, ink is removed from the storage unit via the introduction path 44, and the flow path inner portion is filled with ink from the manifold 95 to the nozzle opening 21. Thereafter, by applying a voltage to each piezoelectric actuator 300 corresponding to the pressure generating chamber 12 according to signals from the driving circuit 97, the vibration plate is flexurally deformed along with the piezoelectric actuator 300. In so doing, the pressure in the pressure generating chamber 12 increases, and ink droplets are ejected from a predetermined nozzle opening 21.

Here, providing the Xa direction that is the parallel direction of the nozzle openings 21 that configure the nozzle row of each head main body 110 inclined with respect to the X direction that is the transport direction of the recording sheet S will be described in detail.

Figure 8:
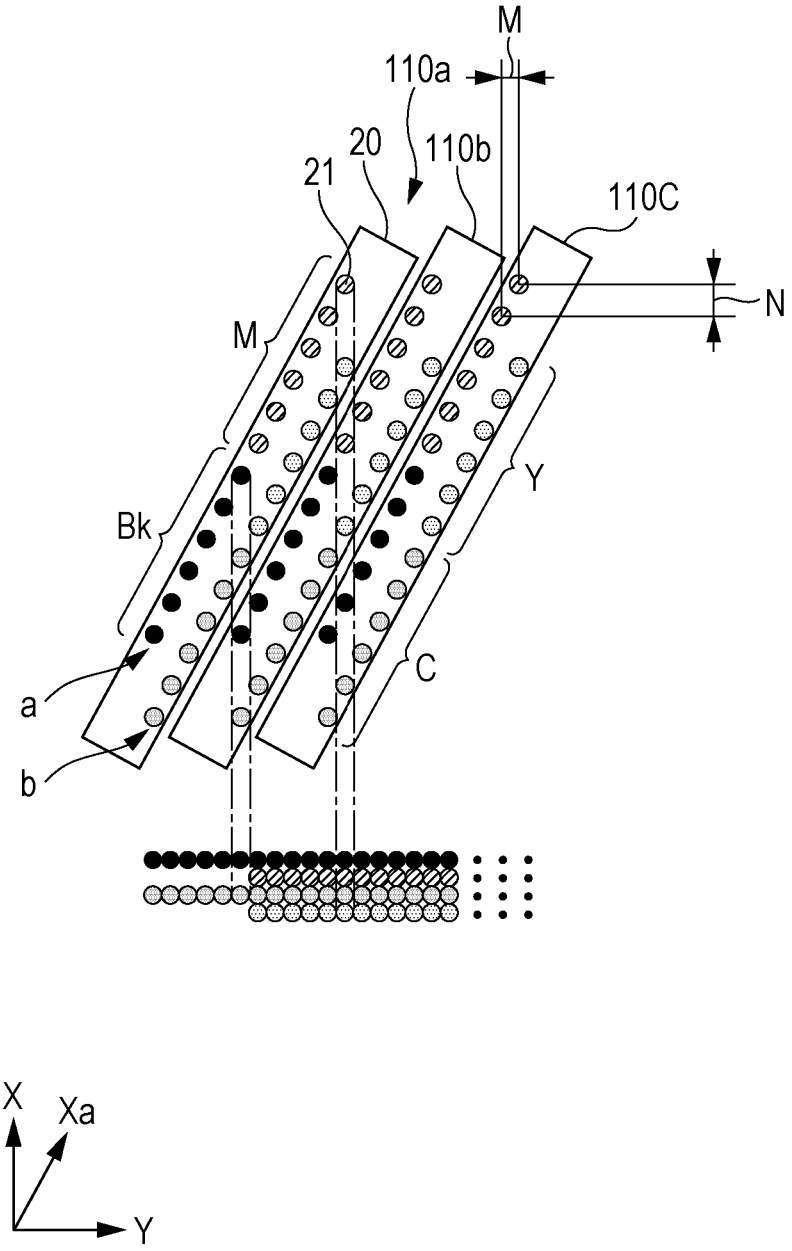
FIG. 8 is an explanatory diagram schematically showing the arrangement of nozzle openings in Embodiment 1 of the invention.

An explanatory diagram schematically illustrating the arrangement of the nozzle openings 21 of the head main body 110 according to the embodiment is shown in FIG. 8. As shown in FIG. 8, two nozzle rows of nozzle openings 21 are provided in one nozzle plate 20, and the nozzle openings 21 of the nozzle rows are arranged in parallel in the Xa direction inclined by a predetermined angle with respect to the X direction that is the transport direction. The Xa direction in which the nozzle openings 21 are arranged together is inclined with respect to the X direction, and the nozzle openings 21 of each nozzle row overlap in the X direction between the two nozzle rows in the head main body 110.

Here, the distance between nozzle openings 21 in a case in which the nozzle openings 21 of each nozzle row are projected in the X direction with respect to a virtual line in the Y direction is M. The distance between nozzle openings 21 in a case in which the nozzle openings 21 of each nozzle row are projected in the Y direction with respect to a virtual line in the X direction is N.

In the example, it is possible for two types of liquid to be ejected by one nozzle row, and four types to be ejected by two nozzle rows. That is, assuming the use of four colors of ink, for example, it is possible for black Bk and magenta M to be ejected in the nozzle row a, and cyan C and yellow Y in the nozzle row b. The nozzle rows a and b have the same number of nozzle openings 21, and the position of the nozzle openings 21 of the nozzle row a in the Y direction and the position of the nozzle openings 21 of the nozzle row b overlap in the X direction.

By the head main bodies 110*a* to 110*c* having similar nozzle rows a and b, and the head main bodies 110*a* to 110*c* being provided in close contact in the Y direction, each nozzle opening 21 of the head main bodies 110 neighboring in the Y direction are provided in parallel so as to overlap each other in the X direction. Thus, it is possible to print a color image four colors are aligned in the X direction by the magenta M nozzle row a and the yellow Y nozzle row b of the head main body 110*a* overlapping the black Bk nozzle row a and the cyan C nozzle row b of the head main body 110*b* in the Y direction. Even for the head main body 110*b* and the head main body 110*c* neighboring in the Y direction, each nozzle opening 21 is arranged in parallel so as to overlap each other in the X direction.

It is possible for the image quality of joints between the head main bodies 110 to be improved by the at least a portion of the nozzle openings 21 from the same color nozzle rows having neighboring head main bodies 110 being arranged so as to overlap each other in the X direction. That is, for example, in FIG. 8, by one nozzle opening 21 of the magenta M nozzle row a of the head main body 110*a* and the one nozzle opening 21 of the magenta M nozzle row a of the head main body 110*b* being arranged so as to overlap each other in the X direction and controlling the ejection from the two nozzle openings 21 that overlap each other, it is possible to prevent deterioration of the image quality, such as banding or stripes, in the joints between neighboring head main bodies 110. In FIG. 8, although only one nozzle opening 21 is overlapped in the X direction, two or more nozzle openings 21 may overlap in the X direction.

Figure 9:
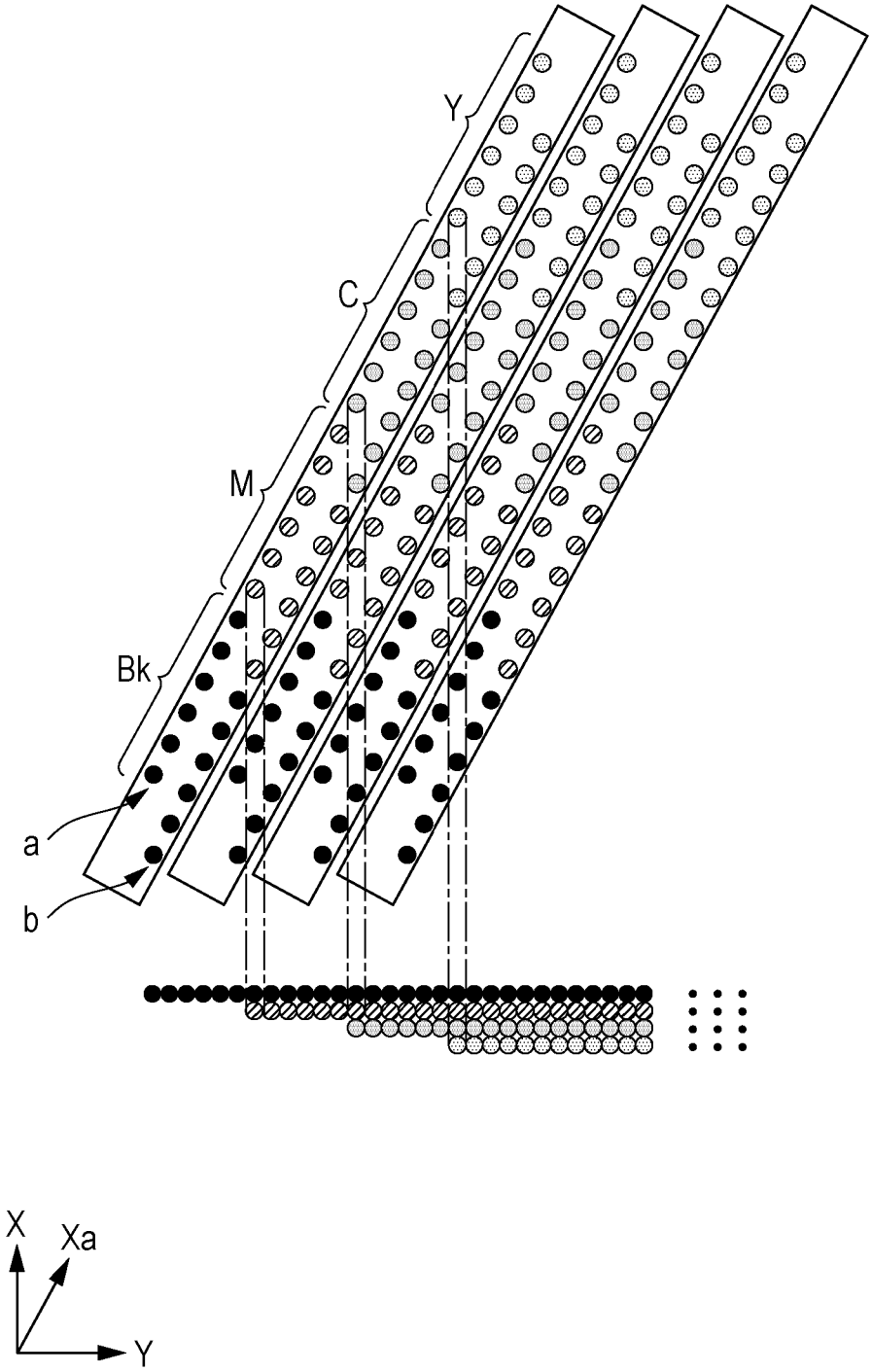
FIG. 9 is an explanatory diagram schematically illustrating the arrangement of nozzle openings in a modification example of Embodiment 1.

Such a color arrangement is, naturally, not limited thereto. For example, as shown in FIG. 9, the four colors of black Bk, magenta M, cyan C and yellow Y are preferably arranged so as to hit in one row.

As described above, the head unit 3 is configured by fixing four ink jet recording heads 100 having a plurality of head main bodies to the head fixing substrate 200; however a portion of the nozzle rows are arranged in the neighboring ink jet recording heads 100 so as to overlap each other in the X direction. That is, similarly to the relationship of the neighboring head main bodies 110 in one ink jet recording head 100, by providing neighboring head main bodies 110 between neighboring ink jet recording heads 100 in close contact in the Y direction, it is possible for image quality of joints between neighboring ink jet recording heads 100 to be improved along with enabling printing of a color image between neighboring ink jet recording heads 100. Naturally, the number of nozzle openings 21 that overlap in the X direction between neighboring ink jet recording heads 100 is not necessarily the same as the number of nozzle openings 21 that overlap in the X direction between head main bodies 110 on one ink jet recording head 100.

In this way, by nozzle rows between head main bodies and nozzle rows between ink jet recording heads partially overlapping in the X direction, it is possible for the image quality of joints to be improved.

Since it is possible to make the order of overlapping in the third direction between nozzle rows in the head unit and the order of overlapping in the third direction between nozzle rows in head units the same by multiple colors of ink being arranged in one head main body as described above, there is an advantage in that it is possible to even out the overlapping order of colors.

Although the X direction and Xa direction preferably intersect at an angle greater than 0 degrees and less than 90 degrees, it is preferable to intersect at an angle greater than 0 degrees and less than 45 degrees. Thereby, it is possible to reduce the inter-nozzle distance in the Y direction compared to a case of intersecting at an angle greater than 45 degrees and less than 90 degrees, and it is possible to realize a high resolution head. Naturally, the X direction and Xa direction preferably intersect at an angle greater than 45 degrees and less than 90 degrees.

Between the neighboring nozzle openings 21 in the Xa direction of each nozzle row, it is preferable that the nozzle pitch and the angle of the X direction and the Xa direction be set so that the distance N in the X direction and the distance M that is the distance in the Y direction become an integer ratio. Thereby, association of each nozzle and pixel becomes easy in a case of printing image data configured from pixels arranged in a matrix form in the X and Y directions. Naturally, there is no limitation thereto.

Figure 10A:
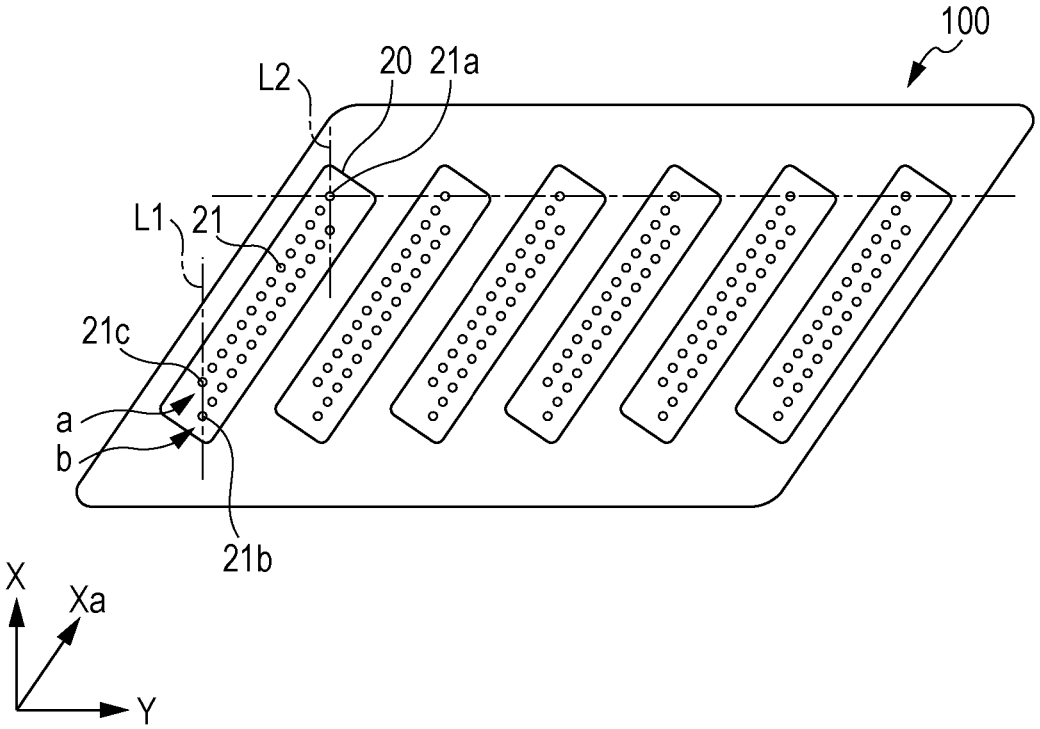
FIGS. 10A and 10B are explanatory diagrams schematically illustrating the arrangement of nozzle openings in Embodiment 1.
Figure 10B:
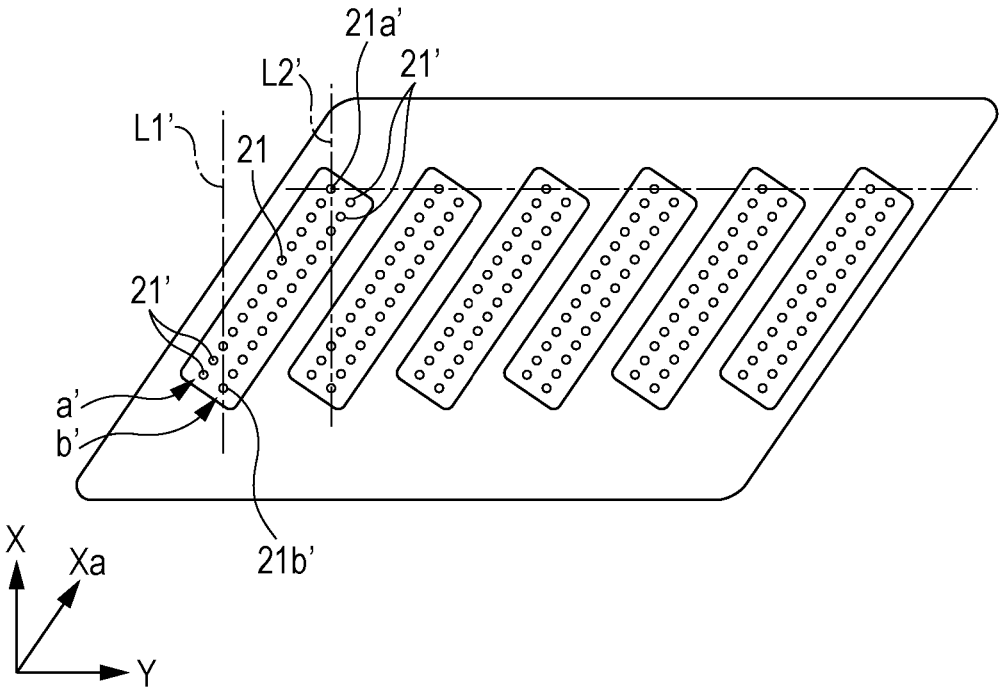

Here, diagrams describing the arrangement of the nozzle openings 21 in the head main body in further detail is shown in FIGS. 10A and 10B. As shown in FIG. 10A, in the embodiment, in a case in which one side in the Y direction is the first side, the nozzle row a furthest to the first side does not have a nozzle opening positioned further the first side in the Y direction than the nozzle opening 21*b* furthest to the first side of the nozzle row b neighboring in the Y direction. That is, even though the nozzle row a has a nozzle opening 21 that is the same position as the line L1 with respect to the line L1 that is the position of the nozzle opening 21*b* furthest to the first side of the nozzle row b, the nozzle row does not have a nozzle opening further to the first side than the line L1.

In the embodiment, in a case in which the other side in the Y direction is the second side, the nozzle row b furthest to the second side does not have a nozzle opening positioned further the second side in the Y direction than the nozzle opening 21*a* furthest to the second side of the nozzle row a neighboring in the Y direction. That is, even though the nozzle row b has a nozzle opening 21 that is the same position as the line L2 with respect to the line L2 that is the position of the nozzle opening 21*a* furthest to the second side of the nozzle row a, the nozzle row does not have a nozzle opening further to the second side than the line L2. In so doing, in a case in which the head main bodies 110 are provided together in the Y direction, unnecessary nozzle openings are not present on either of the first and the second sides in the Y direction.

FIG. 10B depicts an arrangement without such limitations, and the nozzle row a' has two nozzle openings 21' further to the first side than the line L1' that is the position of the nozzle opening 21*b'* furthest to the first side of the nozzle row b'. In the embodiment, although the Xa direction in which the nozzle openings 21 are arranged together is inclined with respect to the X direction, and the nozzle openings 21 of each nozzle row overlap in the X direction between the two nozzle rows in the head main body 110, the nozzle opening 21' further to the first side than the line L1' from the nozzle openings of the nozzle row a' does not overlap the nozzle opening 21 of the nozzle row b' of the same head main body 110 in the X direction.

The nozzle row b' has two nozzle openings 21' further to the second side than the line L2' that is the position of the nozzle opening 21*a'* furthest to the second side of the nozzle row a'. Even here, the nozzle opening 21' further to the second side than the line L2' from the nozzle openings of the nozzle row b' does not overlap the nozzle opening 21 of the nozzle row a' of the same head main body 110 in the X direction. Naturally, since the head main bodies 110 are arranged together in the Y direction, the nozzle opening 21' further to the second side than the line L2' form the nozzle openings of the nozzle row b' may overlap the nozzle opening 21' of the nozzle row a' of the head main body 110 neighboring in the Y direction. However, for the head main body 110 furthest to the second side from the plurality of head main bodies 110 the ink jet recording head 100 includes, the nozzle opening 21' further to the second side than the line L2' from the nozzle openings of the nozzle row b' does not overlap the nozzle opening 21 of the nozzle row a' of the same head main body 110 in the X direction. In the embodiment, since head unit 3 includes four ink jet recording heads 100 provided together in the Y direction, it is possible for nozzle openings that overlap in the X direction between ink jet recording heads 100 neighboring in the Y direction, as described above. However, for the head main body 110 furthest to the second side from the plurality of head main bodies 110 the head unit 3 includes, the nozzle opening 21' further to the second side than the line L2' from the nozzle openings of the nozzle row b' does not overlap the nozzle opening 21 of the nozzle row a' of the same head main body 110 in the X direction.

That is, since the four nozzle openings 21' do not overlap in the X direction the nozzle openings of the other nozzle row in the same head main body 110, there may be unnecessary nozzle openings.

In the embodiment, as described above, a structure in which such unnecessary nozzle openings are removed is included.

In the embodiment, although in this way unnecessary nozzle openings are not present on both sides, unnecessary nozzle openings are preferably removed from only one side.

In the embodiment, although the head main bodies 110 are arranged together in the Y direction and the head unit 3 is configured by a plurality of head main bodies 110, the head unit 3 is preferably configured by one head main body 110.

In the embodiment, in a case in which one side in the Y direction is the first side, the nozzle row a furthest to the first side does has a nozzle opening 21*c* furthest to the first side at the same position in the Y direction as the nozzle opening 21*b* furthest to the first side of the nozzle row b neighboring in the Y direction. Thereby, it is possible to eject different types of liquid for each nozzle row. However, the position in the Y direction of the nozzle openings in both rows is not necessarily the same.

In the embodiment, each nozzle row a and b has the same number of nozzle openings 21. Thereby, it is possible for the number of overlaps between each nozzle row in the X direction to be the same, and efficient liquid ejection is possible. However, the number of nozzle openings in each row is not necessarily the same.

In the embodiment, it is preferable that head main body have one nozzle plate 20 with respect to two nozzle rows. Thereby, it is possible to realize the arrangement of each nozzle row with higher precision. Naturally, a separate nozzle plate is preferably provided for each row. The nozzle plate 20 is configured from a stainless steel (SUS) plate, a silicon substrate, or the like.

In the embodiment described above, although two nozzle rows provided in one head main body was described as an example, it goes without saying that similar effects to the above are exhibited even in a head main body including 3 or more nozzle rows. As in the embodiment, if the two nozzle rows are provided in one head main body 110, as in FIG. 7, by being able to arrange nozzle openings 21 of each of the nozzle rows between the two manifolds 95 corresponding to each nozzle row, it is possible for the gap in the Ya direction of the two nozzle rows to be narrowed, compared to a case in which the nozzle openings 21 of a plurality nozzle row are arranged on the same side with respect to the manifold corresponding to each of the nozzle rows. Therefore, it is possible for the area necessary for one nozzle plate 20 with respect to two nozzle rows to be reduced. Connecting each of the piezoelectric actuator 300 and the wiring substrate 98 of the two nozzle rows becomes easy.

The kinds of liquid ejected by the nozzle rows a and b are preferably all the same, and for example, inks all of the same color are preferably used.

Embodiment 2

In the above-described embodiment, when viewed in plan view from the liquid ejecting surface 20*a* side, although an example an ink jet recording head 100 in which six head main bodies having rectangular nozzle plates 20 are fixed to the cover 130 that is a fixing plate having a substantially parallelogram shape is described, the shape of the nozzle plate is not limited thereto.

Since the embodiment is the same as the above-described embodiment other than the nozzle plate 20A having a parallelogram shape being included, overlapping description will not be made.

Figure 11:
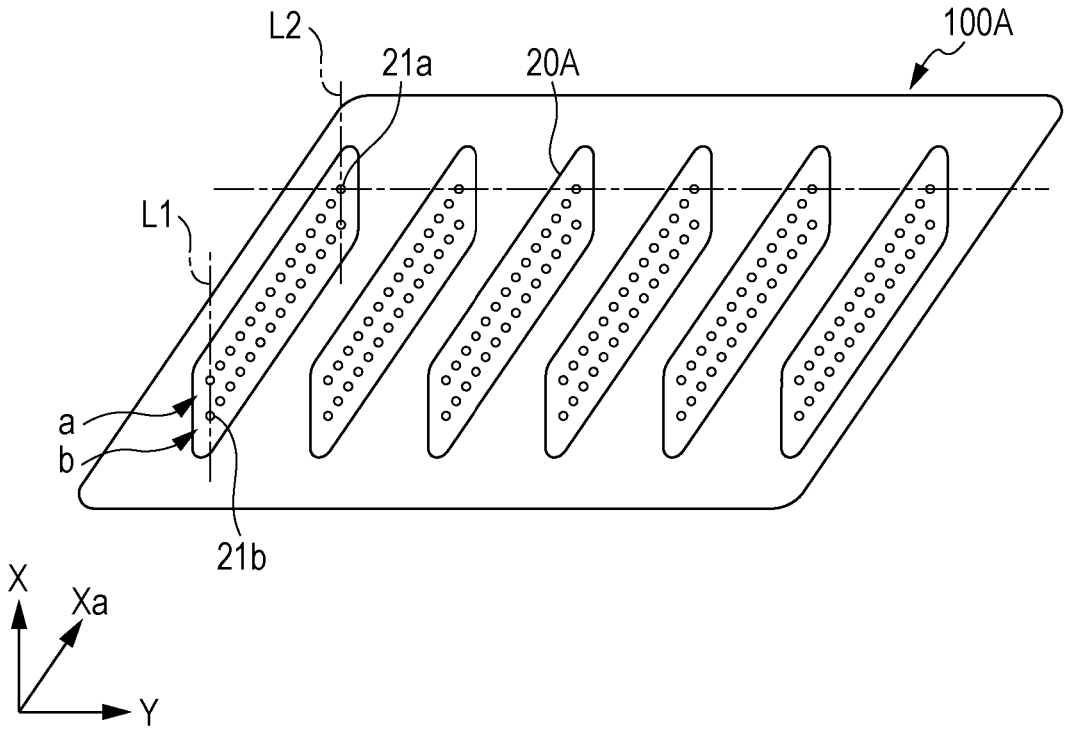
FIG. 11 is an explanatory diagram schematically illustrating the arrangement of nozzle openings in Embodiment 2.

FIG. 11 is a plan view from the liquid ejecting surface side of the ink jet recording head 100A. As shown in the drawings, the nozzle plate 20A includes a parallelogram shape having sides along each of the X and Y directions. That is, the outline of the nozzle plate 20A approaches the outline of the arrangement of the nozzle openings 21 of the two nozzle rows a and b provided in the nozzle plate 20A. Thereby, it is possible to effectively arrange the collection of a plurality of nozzle rows arranged in a parallelogram shape, to reduce the size of the nozzle plate, and integration is possible.

Embodiment 3

In the above-described embodiments, although an example is shown of nozzle openings overlapping in the X direction between neighboring nozzle rows of one head main body, the nozzle openings are preferably arranged shifted by a predetermined pitch. That is, in a case in which the distance in the Y direction between the nozzle openings is M in a case when each nozzle opening of each nozzle row is projected in the X direction in L rows that are at least two rows, the positions of the nozzle openings of each nozzle row are preferably arranged shifted in the Y direction by M×(1/L) each.

Figure 12A:
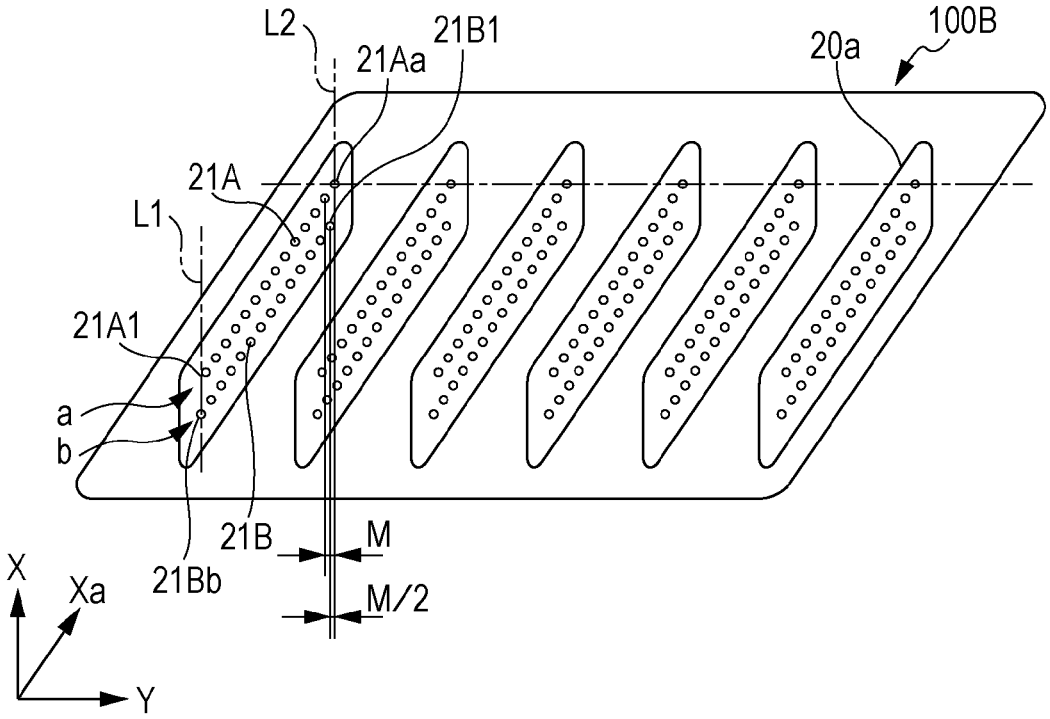
FIGS. 12A and 12B are explanatory diagrams schematically illustrating the arrangement of nozzle openings in Embodiment 3.
Figure 12B:
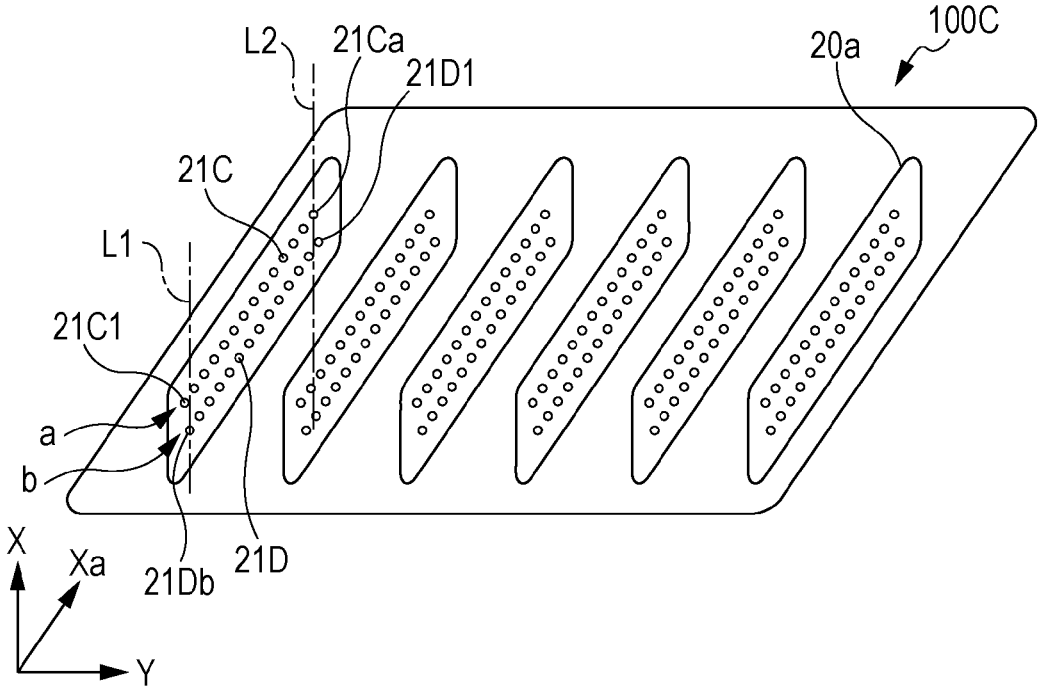

FIGS. 12A and 12B are plan views seen from the liquid ejecting surface side of the ink jet recording head 100B, in a case where L=2.

As shown in FIG. 12A, the nozzle opening 21B of the nozzle row b is present between the positions in the Y direction of the two neighboring nozzle openings 21A of the nozzle row a. In a case where L=3, the nozzle opening of the second nozzle row and the nozzle opening of the third nozzle row may be present shifted by ⅓ pitch each between the positions in the Y direction of the neighboring nozzle openings of the first nozzle row.

Even in an ink jet recording head 100B having such nozzle openings 21A and 21B, in a case in which one side in the Y direction is the first side, the nozzle row a furthest to the first side does not have a nozzle opening positioned on the first side at a distance M or more in the Y direction than the line L1 that is the position of the nozzle opening 21B*b* furthest to the first side of the nozzle row b neighboring in the Y direction. In so doing, unnecessary nozzle openings are not present. The nozzle opening 21A1 furthest to the first side of the nozzle row a is present at a position shifted by M/2 in the reverse direction to the first side in the Y direction.

In the embodiment, in a case in which one side in the Y direction is the second side, the nozzle row b furthest to the second side does not have a nozzle opening positioned further to the second side at a distance M or more in the Y direction than the line L2 that is the position of the nozzle opening 21A*a* furthest to the second side of the nozzle row a neighboring in the Y direction. In so doing, unnecessary nozzle openings are not present, even on the reverse side. If the number of nozzle openings of the nozzle rows a and b is the same, the nozzle opening 21B1 furthest to the second side of the nozzle row b is present at a position shifted by M/2 to the reverse direction to the second side in the Y direction.

FIG. 12B is a modification example in which the position of the nozzle openings is shifted to the reverse side to FIG. 12A.

Even in an ink jet recording head 100C having such nozzle openings 21C and 21D, in a case in which one side in the Y direction is the first side, the nozzle row a furthest to the first side does not have a nozzle opening positioned on the first side at a distance M or more in the Y direction than the line L1 that is the position of the nozzle opening 21D*b* furthest to the first side of the nozzle row b neighboring in the Y direction. In so doing, unnecessary nozzle openings are not present. The nozzle opening 21C1 furthest to the first side of the nozzle row a is present at a position shifted by M/2 to the first side in the Y direction, and the above-described conditions are satisfied.

In the embodiment, in a case in which the other side in the Y direction is the second side, the nozzle row b furthest to the second side does not have a nozzle opening positioned further to the second side at a distance M or more in the Y direction than the line L2 that is the position of the nozzle opening 21C*a* furthest to the second side of the nozzle row a neighboring in the Y direction. In so doing, unnecessary nozzle openings are not present, even on the reverse side. The nozzle opening 21D1 furthest to the second side of the nozzle row b is present at a position shifted by M/2 to the second side in the Y direction, and the above-described conditions are satisfied.

Also in the embodiment, it is possible for a structure in which such unnecessary nozzle openings are removed to be realized.

In the embodiment, in a case in which one side in the Y direction is the first side, and the first side is "plus" and the second side is "minus", the nozzle row furthest to the first side has a nozzle opening furthest to the first side of the neighboring nozzle in the Y direction and a nozzle opening furthest to the first side at a position of $-M\times(L-1)/L$ or more and $M\times(L-1)/L$ or less to the first side in the Y direction, and it is possible for the nozzles of the nozzle row to be efficiently utilized.

In the embodiment, in a case in which the other side in the Y direction is the second side, and the first side is "plus" and the second side is "minus", the nozzle row furthest to the second side has a nozzle opening furthest to the second side of the nozzle row adjacent in the Y direction and a nozzle opening furthest to the second side at a position on the second side of $-M\times(L-1)/L$ or more and $M\times(L-1)/L$ or less in the Y direction, and it is possible for the nozzles of the nozzle row to be efficiently utilized.

Other Embodiments

Thus far, Embodiments 1 to 3 of the invention have been described; however the basic configuration of the invention is not limited to those described above.

For example, in the above-described Embodiments 1 to 3, although an example in which a plurality of head main bodies is fixed to the cover that is a fixing plate, only one head main body is preferably provided on the fixing plate.

Although an example of ejecting a plurality of liquids with one head main body is shown, the type of liquid is preferably changed for each head main body, or the type of liquid is preferably changed for each nozzle row.

For example, in Embodiments 1 to 3 described above, although a plurality of members, such as the head main body 110, the flow channel-forming substrate 10, the communication plate 15, the nozzle plate 20, the protective substrate 30, the compliance substrate 45, and the case 40, are provided, at least a pressure generating unit that generates pressure in the pressure generating chamber 12 communicated with the nozzle openings 21 for ejecting liquid from the nozzle openings 21 provided in the liquid ejecting surface 20*a*, and a plurality of pressure generating chambers 12 in which the pressure generating units are provided, and which are arranged in parallel along a predetermined direction may be provided. That is, in Embodiment 1 described above, although the Z1 side of the holder 120 is adhered to the Z2 side of the head main body 110, and the head main body is layered furthest to the Z2 side of the case 40, it is not necessary for the head main body 110 to be adhered to the holder 120 via the case 40, and the head main body 110 is preferably adhered to the holder 120 without involving the case 40.

In Embodiments 1 to 3 described above, although the cover 130 that is a fixing plate provided on the liquid ejecting surface 20*a* of the ink jet recording head 100 and the nozzle plate 20 in which the nozzle openings 21 of the head main body 110 are provided are separate bodies, there is no particular limitation thereto, and the nozzle plate 20 preferably extends to the outside of the head main body 110, and the bent portion 132 is preferably provided by bending the extended end portion to the Z2 direction. That is, in this case, the nozzle plate 20 corresponds to the fixing plate, and the nozzle plate 20 is adhered with respect to the head main body 110. That is, the fixing plate is provided on the liquid ejecting surface 20*a* with respect to the head main body 110, and one surface of the fixing plate also includes the liquid ejecting surface 20*a*. Because the fixing plate is preferably provided on the liquid ejecting surface 20*a* with respect to the head main body 110, the fixing plate may be provided projecting to the furthest liquid ejecting surface 20*a* side. That is, in the Embodiments 1 to 3 described above, the liquid ejecting surface 20*a* of the nozzle plate 20 is preferably provided projecting further to the Z1 side than the cover 130. Another member different to the nozzle plate 20 may be provided on the liquid ejecting surface 20*a* side of the ink jet recording head 100 further to the Z1 side than the fixing plate. In a case in which the fixing plate is provided on the opposite side of the holder 120 with respect to the head main body 110, the fixing plate is provided on the liquid ejecting surface 20*a* side with respect to the head main body 110.

In the Embodiments 1 to 3 described above, although a so-called line-type recording apparatus the head unit 3 is fixed to the apparatus main body 2, and that performs by transporting the recording sheet S only is given as an example of the ink jet recording apparatus 1, there is no particular limitation thereto, and the invention is also applicable to a so-called serial-type recording apparatus in which the head unit 3 is mounted to a carriage that moves in a direction that intersects the X direction that is the transport direction of the recording sheet S, for example, the Y direction, and performs printing while moving the head unit 3 in the direction that intersects the transport direction. The configuration that transports the recording sheet S with respect to the head unit 3 is not limited, and printing may be performed by a configuration in which the head unit 3 is moved with respect to the recording sheet S, or the recording sheet S may be relatively transported with respect to the head unit 3.

Not only the nozzles corresponding to the pixels of the image data, but also so-called dummy nozzles that are nozzles not corresponding to the pixels of the image data are preferably included in the nozzle openings 21 provided in the nozzle rows. Thereby, in each nozzle row, it is possible to make the influence exerted from the neighboring nozzles during liquid ejection between the nozzles of the end portion and the nozzles of the center. It is possible for the dummy nozzles to be provided furthest to both sides in the Xa direction from the nozzle openings 21 of one nozzle row that eject the same type of fluid, or to be provided on one side only.

In Embodiments 1 to 3 described above, although use of the piezoelectric actuator 300 layered in the Z direction as the pressure generating unit that generates pressure changes in the pressure generating chamber 12 is described, the piezoelectric actuator 300 is preferably thin film type formed by a film formation and lithography method, or a thick film type formed by a method such as applying a green sheet. It is possible to use a vertical vibration type piezoelectric actuator 300 that stretches in the axial direction by alternately layering a piezoelectric material and an electrode forming material. It is possible to use a pressure generating unit in which a heating element is arranged in the pressure generating chamber, and ejects liquid droplets from the nozzle openings 21 through a bubble generated with the heat of the heat generating element, or a so-called electrostatic actuator or the like that generates static electricity between the vibration plate and an electrode, and ejects liquid droplets from the nozzle openings 21 by deforming the vibration plate through electrostatic force.

What is claimed is:

1. A liquid ejecting head comprising:

a nozzle main body including nozzle rows in which nozzles are lined up with a predetermined nozzle pitch in a first direction and which are L (L is an integer of 2 or more) nozzle rows parallel to one another, wherein the head main body includes a nozzle plate in which the nozzles are provided, and a driving element for ejecting a liquid from the nozzles, wherein each nozzle row is provided such that the distance between nozzles in each nozzle row is M in a case in which a nozzle position of each nozzle row is projected in a third direction orthogonal to a second direction with respect to a virtual line in the second direction that intersects the first direction at a predetermined angle in a range of 0 to 90 degrees, the first direction differs from the second direction, and a plurality of the nozzle positions of each nozzle row overlap between the L nozzle rows in a case in which the nozzle positions of L nozzle rows is projected in the third direction with respect to a virtual line in the second direction, and wherein a nozzle row furthest to the first side among the L nozzle rows does not have a nozzle positioned M or more further to the first side in the second direction than a nozzle of the nozzle row neighboring in the second direction furthest to the first side in a case in which one side in the second direction is the first side, and wherein the liquid ejecting head is configured to eject multi-color liquid in a same position in the second direction.

2. The liquid ejecting head according to claim 1, wherein, in a case in which another side in the second direction is a second side, a nozzle row furthest to the second side among the L nozzle rows does not have a nozzle positioned M or more further to the second side in the second direction than nozzles of a nozzle row neighboring in the second direction furthest to the second side.

3. The liquid ejecting head according to claim 1, wherein the nozzle row furthest to the first side includes a nozzle furthest to the first side of the nozzle row neighboring in the second direction, and a nozzle furthest to the first side at the same position in the second direction.

4. The liquid ejecting head according to claim 1, wherein the nozzle row furthest to the first side includes a nozzle furthest to the first side of the nozzle row neighboring in the second direction, and a nozzle furthest to the first side at a position on the first side of $-M\times(L-1)/L$ or more and $M\times(L-1)/L$ or less in the second direction.

5. The liquid ejecting head according to claim 1, wherein each nozzle row includes the same number of nozzles.

6. The liquid ejecting head according to claim 1, wherein the head main body includes one nozzle plate with respect to the L nozzle rows.

7. The liquid ejecting head according to claim 6, wherein the nozzle plate has a parallelogram shape having sides along each of the first direction and the third direction.

8. The liquid ejecting head according to claim 1, wherein the first direction and the third direction intersect at an angle greater than 0 degrees and less than 45 degrees.

9. The liquid ejecting head according to claim 1, wherein N and M have an integer ratio relation, when a distance in the third direction between neighboring nozzles of each nozzle row is N.

10. The liquid ejecting head according to claim 1, wherein the L nozzle rows are two nozzle rows.

11. The liquid ejecting head according to claim 1, wherein the two nozzle rows are arranged between manifolds of each of the two nozzle rows in a direction orthogonal to the first direction.

12. The liquid ejecting head according to claim 1, wherein each nozzle row includes a dummy nozzle.

13. The liquid ejecting head according to claim 1, wherein nozzles that eject a plurality of different liquids are included in at least one nozzle row of each nozzle row.

14. A liquid ejecting head unit, wherein a plurality of head main bodies according to claim 1 is arranged fixed to a common fixing plate.

15. A liquid ejecting head unit, wherein a plurality of head main bodies according to claim 2 is arranged fixed to a common fixing plate.

16. A liquid ejecting head unit, wherein a plurality of head main bodies according to claim 3 is arranged fixed to a common fixing plate.

17. The liquid ejecting head unit according to claim 14, wherein the fixing plate has a parallelogram shape having sides along each of the first direction and the third direction.

18. The liquid ejecting head unit according to claim 14, wherein a position of a portion of the nozzle rows of one head main body in the second direction and a position of a portion of the nozzle rows of a head main unit neighboring thereto in the second direction among the plurality of head main units overlap in the third direction.

19. A liquid ejecting line head, wherein a plurality of liquid ejecting head units according to claim 14 is lined up in the second direction.

20. A liquid ejecting apparatus comprising:

the liquid ejecting head according to claim 1.

21. A liquid ejecting apparatus comprising:

the liquid ejecting head unit according to claim 14.

22. A liquid ejecting apparatus comprising:

the liquid ejecting line head according to claim 19.

* * * * *